US008782968B2

(12) United States Patent
Benson

(10) Patent No.: US 8,782,968 B2
(45) Date of Patent: Jul. 22, 2014

(54) PIVOTABLE TOWER FOR ANGLED DRILLING

(75) Inventor: James M. Benson, Rowlett, TX (US)

(73) Assignee: Atlas Copco Drilling Solutions LLC, Garland, TX (US)

( * ) Notice: Subject to any disclaimer, the term of this patent is extended or adjusted under 35 U.S.C. 154(b) by 450 days.

(21) Appl. No.: 13/063,413

(22) PCT Filed: Sep. 21, 2009

(86) PCT No.: PCT/US2009/057723

§ 371 (c)(1), (2), (4) Date: Mar. 10, 2011

(87) PCT Pub. No.: WO2010/033935

PCT Pub. Date: Mar. 25, 2010

(65) Prior Publication Data

US 2011/0162296 A1 Jul. 7, 2011

Related U.S. Application Data

(60) Provisional application No. 61/098,656, filed on Sep. 19, 2008.

(51) Int. Cl.
*E21B 7/02* (2006.01)
*E21B 15/04* (2006.01)

(52) U.S. Cl.
CPC .. *E21B 15/04* (2013.01); *E21B 7/02* (2013.01)
USPC ..... 52/116

(58) Field of Classification Search
CPC ..... E04H 12/18; E04H 12/345; E21B 7/023; E21B 15/00; E21B 15/04
USPC ..... 52/111, 116, 117, 115
See application file for complete search history.

(56) References Cited

U.S. PATENT DOCUMENTS

| | | | | |
|---|---|---|---|---|
| 820,992 | A * | 5/1906 | Jenne | 52/116 |
| 2,825,943 | A * | 3/1958 | Jenne | 403/68 |
| 2,904,310 | A * | 9/1959 | Leonard | 173/27 |
| 3,059,781 | A * | 10/1962 | Bender et al. | 212/290 |
| 3,072,025 | A * | 1/1963 | Cronin | 404/127 |
| 3,181,630 | A * | 5/1965 | Coburn | 175/85 |
| 3,195,695 | A | 7/1965 | McIntyre | |
| 3,245,180 | A * | 4/1966 | Bules et al. | 52/116 |

(Continued)

FOREIGN PATENT DOCUMENTS

DE 3942287 A1 * 7/1991 ..... E04H 12/22

OTHER PUBLICATIONS

International Search Report dated Jan. 12, 2010, PCT/US2009/057723. Atlas Copco Drilling Solutions LLC.

*Primary Examiner* — Christine T. Cajilig
(74) *Attorney, Agent, or Firm* — Schmeiser, Olsen & Watts LLP

(57) ABSTRACT

An interface apparatus between a tower and platform includes a tower support assembly with opposed angle brackets and a first tower support assembly coupler/decoupler which is repeatably moveable between coupled and decoupled conditions with the tower support assembly. In the coupled condition, the coupler/decoupler is capable of coupling to the tower support assembly at a plurality of predetermined positions along the opposed angle brackets. The interface apparatus includes a second tower support assembly coupler/decoupler which allows the tower to pivot relative to the tower support assembly and rotate relative to the platform.

21 Claims, 37 Drawing Sheets

(56) References Cited

U.S. PATENT DOCUMENTS

| | | | | | |
|---|---|---|---|---|---|
| 3,262,237 | A | * | 7/1966 | Jenkins et al. | 52/116 |
| 3,561,616 | A | * | 2/1971 | Eddy et al. | 414/22.53 |
| 3,692,123 | A | | 9/1972 | Gyongyosi | |
| 3,695,363 | A | * | 10/1972 | Kelly, Jr. | 173/195 |
| 3,708,024 | A | | 1/1973 | Back | |
| 3,721,304 | A | * | 3/1973 | Hanson | 173/2 |
| 3,778,940 | A | * | 12/1973 | Blecken | 52/116 |
| 3,802,136 | A | * | 4/1974 | Eiler et al. | 52/115 |
| 3,805,902 | A | * | 4/1974 | Storm et al. | 175/85 |
| 3,815,690 | A | | 6/1974 | Cooper | |
| 3,833,072 | A | | 9/1974 | Back | |
| 3,850,902 | A | | 11/1974 | Storm et al. | |
| 3,905,168 | A | * | 9/1975 | Nelmark et al. | 52/116 |
| 3,968,845 | A | | 7/1976 | Chaffin | |
| 3,992,831 | A | | 11/1976 | Bukovitz et al. | |
| 4,016,687 | A | | 4/1977 | Griffith et al. | |
| 4,020,909 | A | | 5/1977 | Airaudo | |
| 4,074,774 | A | * | 2/1978 | Brown et al. | 173/44 |
| 4,185,945 | A | * | 1/1980 | Gill | 414/727 |
| 4,269,395 | A | * | 5/1981 | Newman et al. | 254/386 |
| 4,295,758 | A | | 10/1981 | Yashima | |
| 4,547,110 | A | * | 10/1985 | Davidson | 414/22.55 |
| 4,595,065 | A | | 6/1986 | Wada et al. | |
| 4,606,155 | A | * | 8/1986 | Bukovitz et al. | 52/116 |
| 4,616,454 | A | | 10/1986 | Ballachey et al. | |
| 4,677,444 | A | * | 6/1987 | Perek | 343/882 |
| 5,158,146 | A | * | 10/1992 | Fuller | 175/122 |
| 5,213,169 | A | * | 5/1993 | Heller | 175/122 |
| 5,988,299 | A | | 11/1999 | Hansen et al. | |
| 6,527,063 | B2 | | 3/2003 | Rust et al. | |
| 6,672,410 | B2 | | 1/2004 | Smith | |
| 6,675,915 | B2 | | 1/2004 | Smith | |
| 7,325,634 | B2 | | 2/2008 | Law et al. | |
| 7,347,285 | B2 | | 3/2008 | Hamner | |
| 7,413,036 | B2 | | 8/2008 | Law et al. | |
| 2008/0210469 | A1 | * | 9/2008 | Volkel et al. | 175/45 |

* cited by examiner

PIVOTABLE TOWER FOR ANGLED DRILLING

CROSS-REFERENCE TO RELATED APPLICATIONS

This application claims priority to U.S. Provisional Application No. 61/098,656, filed on Sep. 19, 2008 by the same inventors, the contents of which are incorporated by reference as though fully set forth herein.

BACKGROUND OF THE INVENTION

1. Field of the Invention

This invention relates generally to towers for drilling machines, and controlling the tilt thereof.

2. Description of the Related Art

There are many different types of drilling machines for drilling through a formation. Some of these drilling machines are mobile and others are stationary. Some examples of mobile and stationary drilling machines are disclosed in U.S. Pat. Nos. 820,992, 3,195,695, 3,245,180, 3,561,616, 3,692,123, 3,695,363, 3,708,024, 3,778,940, 3,805,902, 3,815,690, 3,833,072, 3,905,168, 3,968,845, 3,992,831, 4,016,687, 4,020,909, 4,595,065, 4,606,155, 4,616,454, 5,988,299, 6,527,063, 6,672,410, 6,675,915, 7,325,634, 7,347,285 and 7,413,036, as well as in U.S. Patent Application No. 20080210469. Some drilling machines, such as the one disclosed in U.S. Pat. No. 4,295,758, are designed to float and are useful for ocean drilling. The contents of these cited U.S. patents and the patent application are incorporated by reference as though fully set forth herein.

A typical mobile drilling machine includes a vehicle and tower, wherein the tower carries a rotary head and drill string. In operation, the drill string is driven into the formation by the rotary head. In this way, the drilling machine drills through the formation. More information about drilling machines, and how they operate, can be found in the above-identified references.

In some situations, it is desirable to drill at an angle. Drilling at an angle is useful so that more regions of a formation can be reached with the drill string. For example, in some situations, the drilling machine cannot be positioned directly over a desired region of the formation, so it is not possible to drill straight down and reach this region of the formation. Hence, angled drilling is useful so that the drilling machine can reach a desired region of a formation without being directly over it. In this way, there are many more options available when selecting the location to position the drilling machine.

Angled drilling is typically accomplished by tilting the tower relative to an axis of the drilling machine so that the drill string is tilted in response. More information regarding tilting a tower is provided in U.S. Pat. Nos. 3,245,180, 3,561,616, 3,815,690, 3,778,940, 3,905,168, and 3,992,831, and U.S. Patent Application No. 20080210469, as well as some of the other references mentioned above. However, it is desirable to better control the angle that the tower is tilted, and to provide more stability to the tower when it is in a tilted condition.

BRIEF SUMMARY OF THE INVENTION

The present invention is directed to a drilling machine for angled drilling, as well as a method of manufacturing and using the drilling machine. The novel features of the invention are set forth with particularity in the appended claims. The invention will be best understood from the following description when read in conjunction with the accompanying drawings.

DETAILED DESCRIPTION OF THE INVENTION

Figure 1A:
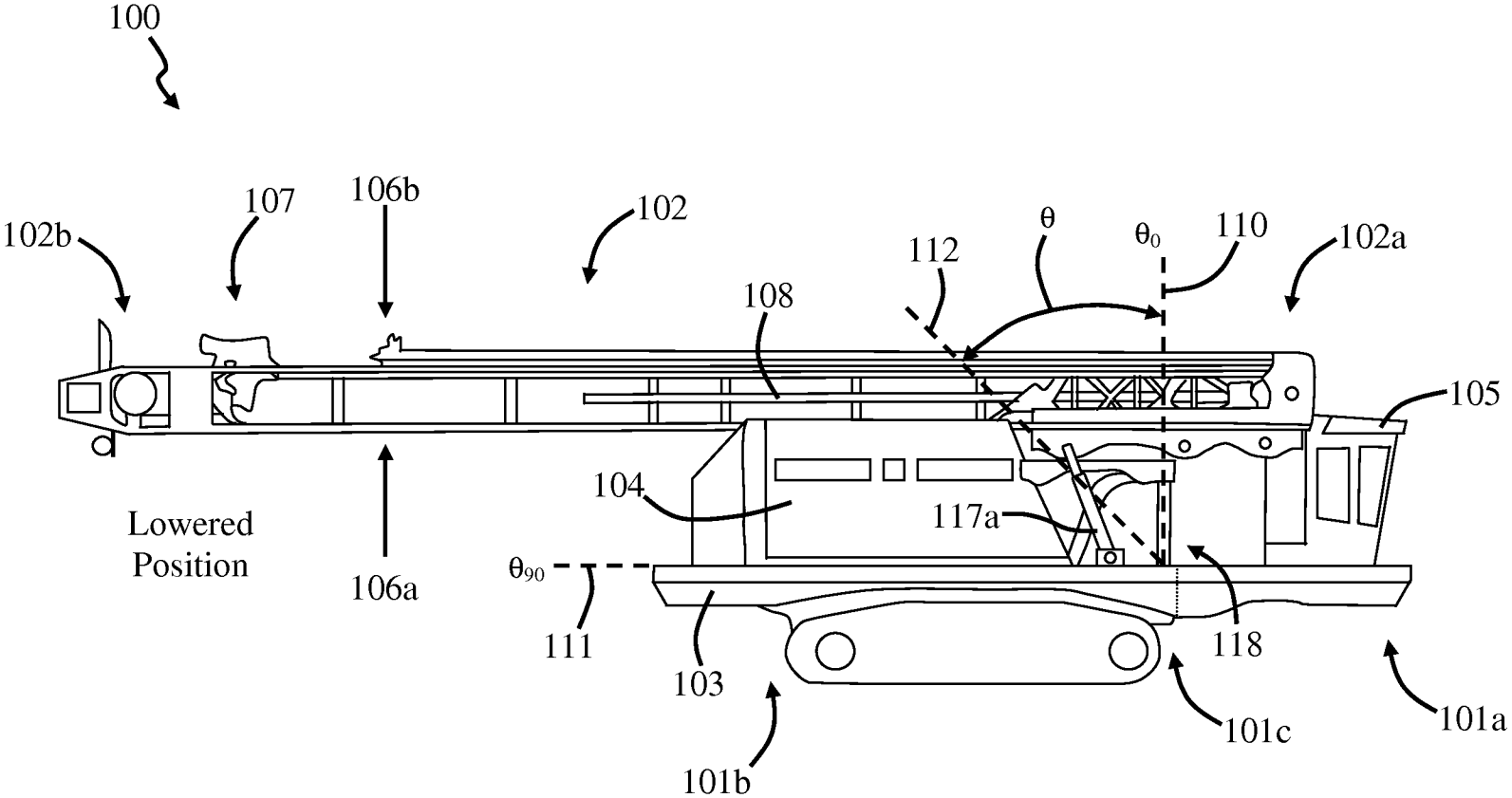
FIG. 1*a* is a side view of a drilling machine with a tower rotatably mounted to a tower interface assembly, wherein the tower and tower interface assembly are carried by a platform, and the tower is in a stowed condition.
Figure 1B:
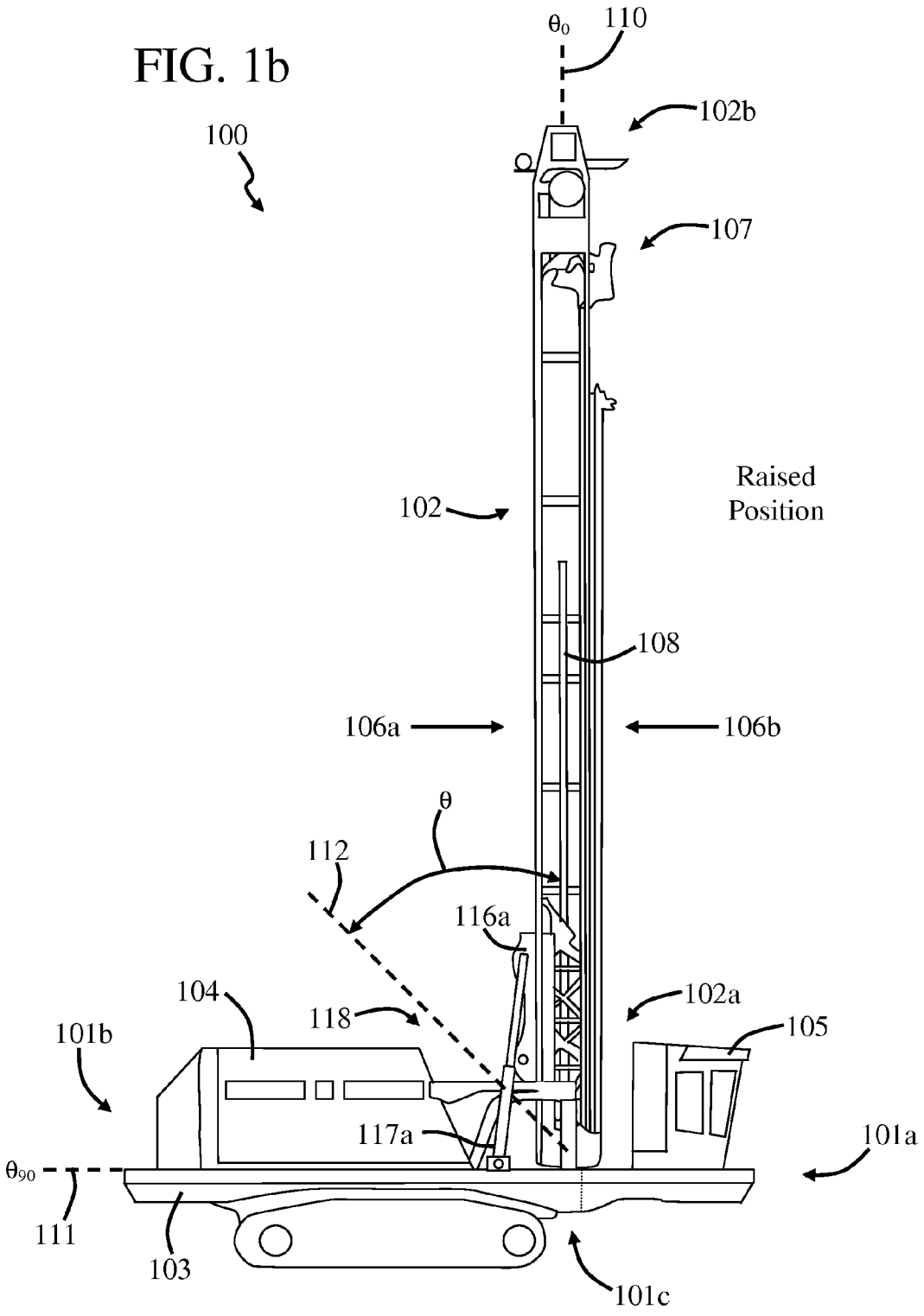
FIGS. 1*b* and 1*c* are opposed side views of the drilling machine of FIG. 1*a*, wherein the tower is in a raised condition.
Figure 1C:
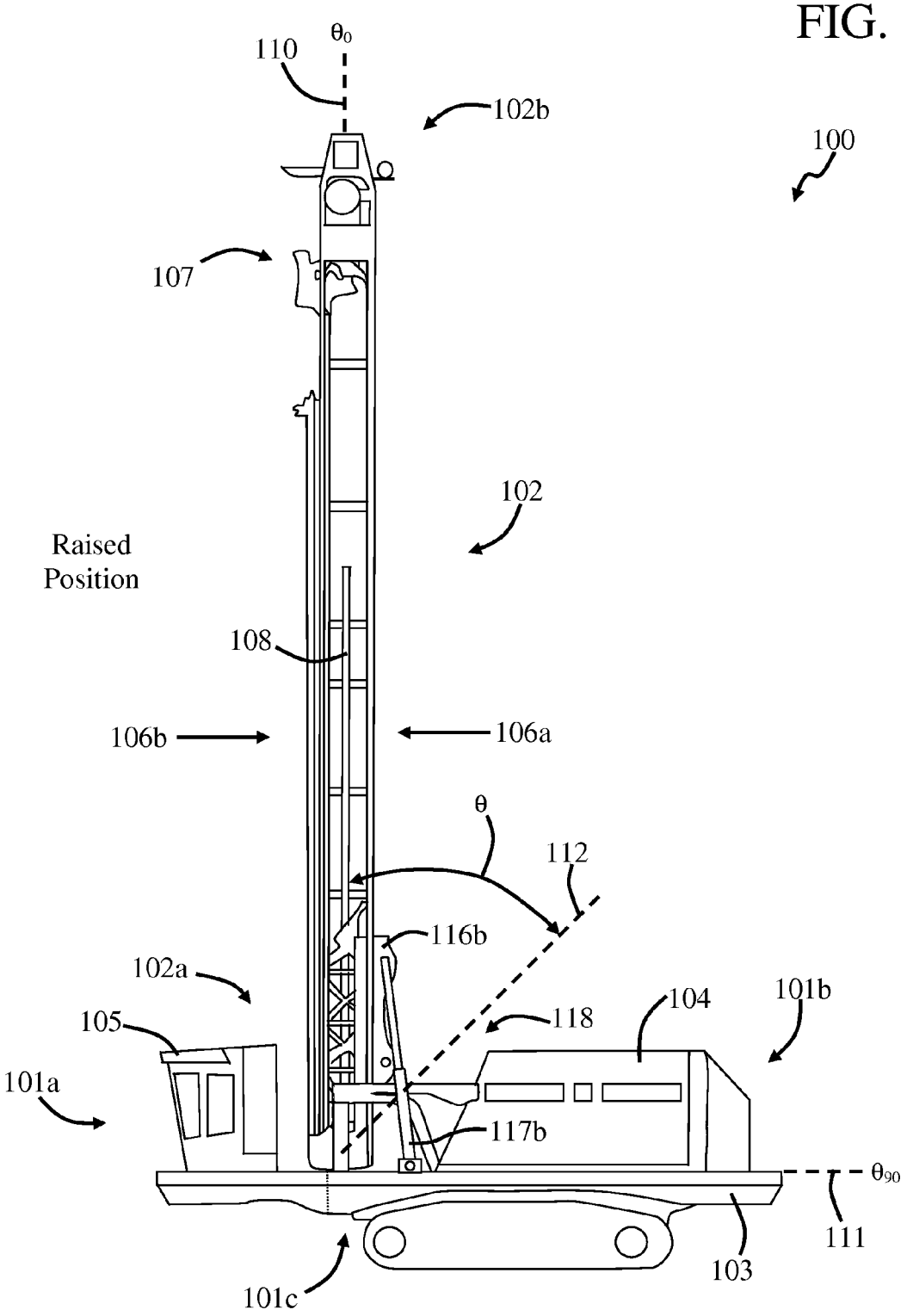
Figure 1D:
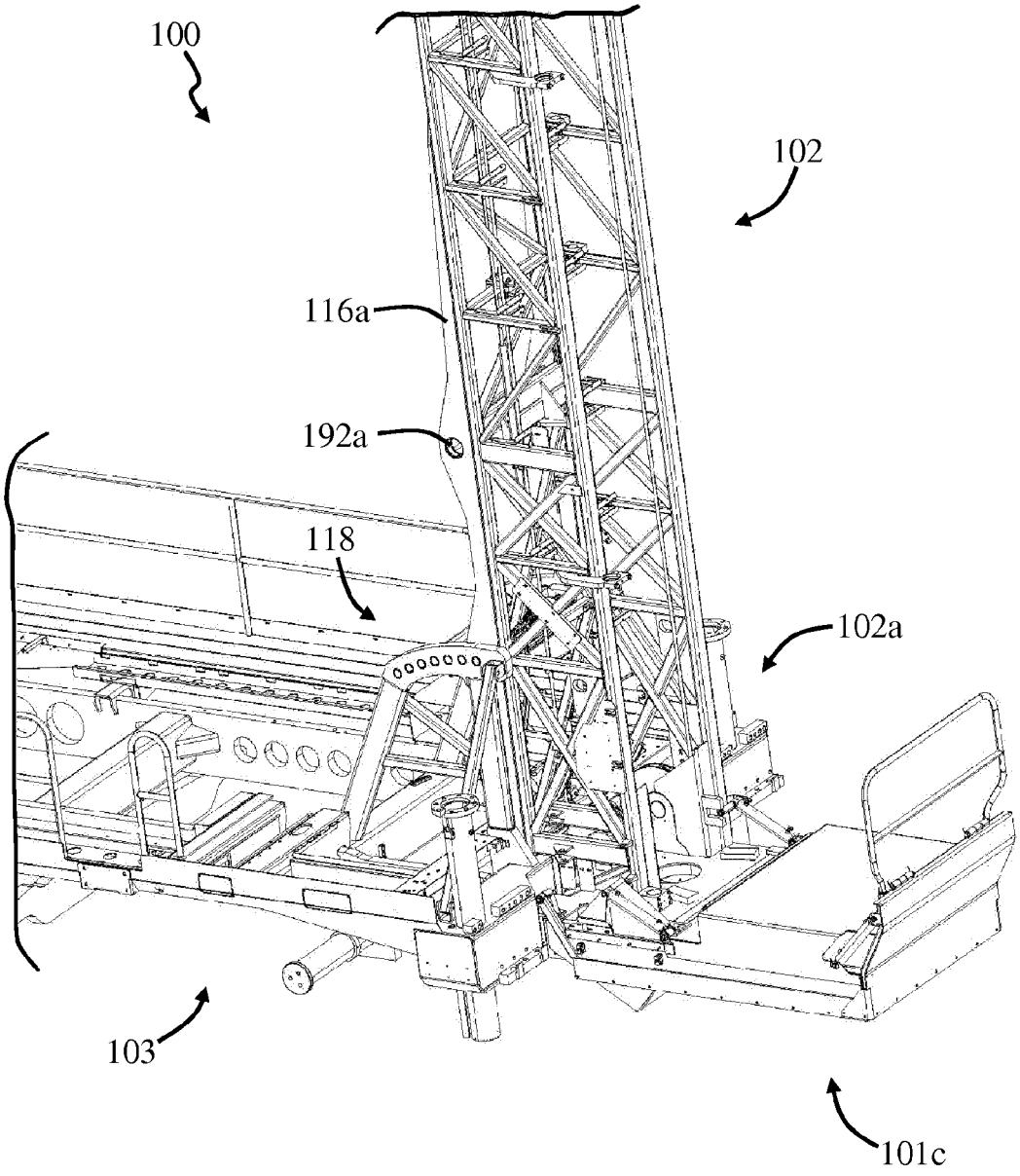
FIGS. 1*d* and 1*e* are close-up front and rear perspective views, respectively, of the drilling machine of FIG. 1*a*, wherein the tower is in the raised condition.
Figure 1E:
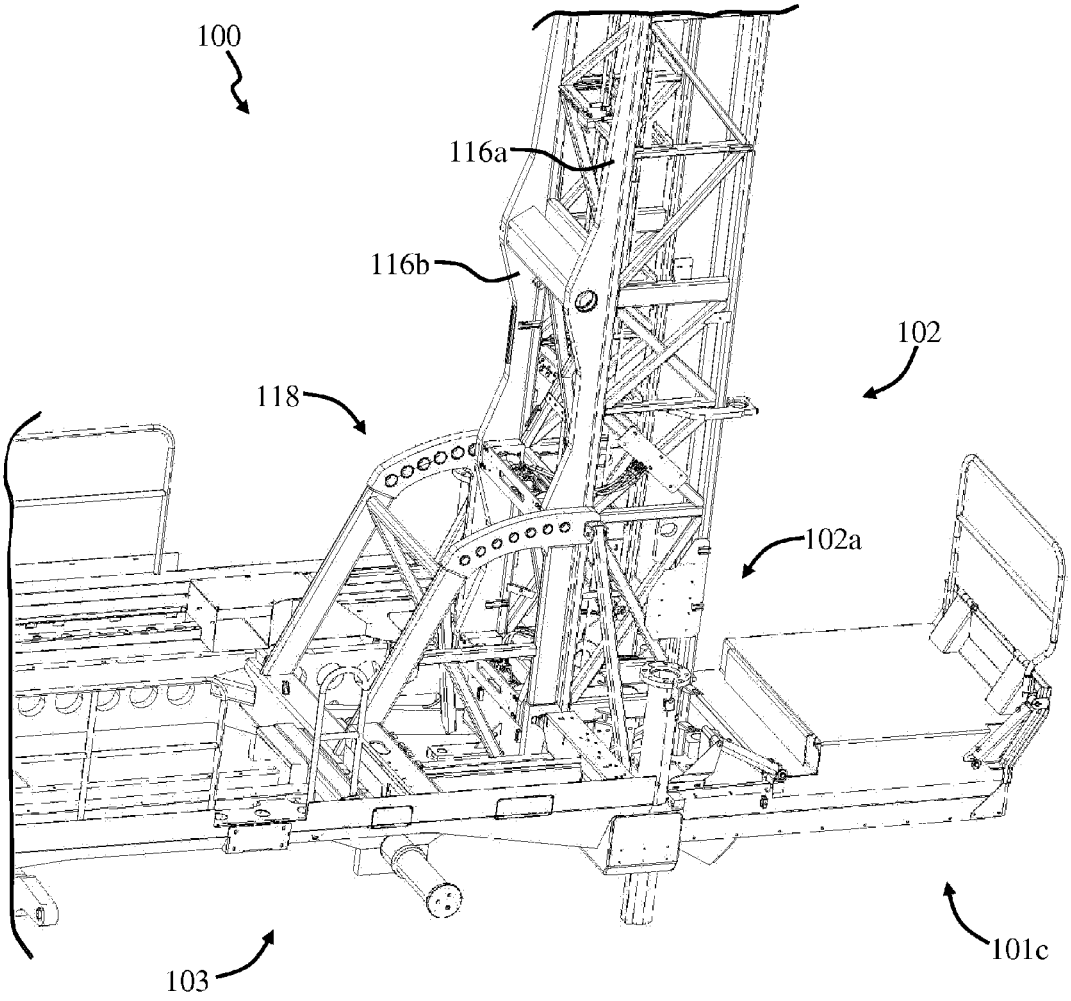

FIG. 1*a* is a side view of a drilling machine 100 with a tower 102 rotatably mounted to a tower interface assembly 118, wherein tower 102 and tower interface assembly 118 are carried by a platform 103, and tower 102 is in a stowed condition. FIGS. 1*b* and 1*c* are opposed side views of drilling machine 100, wherein tower 102 is in a raised condition. FIGS. 1*d* and 1*e* are close-up front and rear perspective views, respectively, of drilling machine 100, wherein tower 102 is in the raised condition.

It should be noted that drilling machine 100 can be a stationary or mobile vehicle, but here it is embodied as being a mobile vehicle for illustrative purposes. Some examples of different types of drilling machines are the PV-235, PV-270, PV-271, PV-275 and PV-351 drilling machines, which are manufactured by Atlas Copco Drilling Solutions of Garland, Tex. It should be noted, however, that drilling machines are provided by many other manufacturers.

In this embodiment, drilling machine 100 includes an operator's cab 105, which is carried by platform 103. Operator's cab 105 is positioned proximate to a vehicle front 101*a* of drilling machine 100. A front 101*c* of platform 103 is positioned proximate to operator's cab 105, so that operator's cab 105 is positioned between front 101*c* of platform 103 and vehicle front 101*a* of drilling machine 100. In this way, operator's cab 105 is positioned proximate to a vehicle front 101*a* of drilling machine 100.

In this embodiment, drilling machine 100 includes a power pack 104 which is carried by platform 103. Power pack 104 typically includes many different components, such as a prime mover. Platform 103 extends to a vehicle back 101*b*, and power pack 104 is positioned between platform front 101*c* and vehicle back 101*b*. In this way, power pack 104 is positioned proximate to a vehicle back 101*b* of drilling machine 100.

It should be noted that the components of drilling machine 100 are typically operated by an operator in operator's cab 105. For example, in this embodiment, drilling machine 100 includes a control system (not shown), which is operatively coupled to power pack 104. The control system includes one or more control inputs which can be adjusted by the operator in operator's cab 105. In this way, power pack 104 is operated by an operator in operator's cab 105. Further, the control system includes one or more input controls for controlling the operation of tower 102, as will be discussed in more detail below.

Tower 102 generally carries a feed cable system (not shown) attached to a rotary head 107, wherein the feed cable system allows rotary head 107 to move between raised and lowered positions along tower 102. The feed cable system moves rotary head 107 between the raised and lowered positions by moving it towards a tower crown 102*b* and tower base 102*a*, respectively.

Rotary head 107 is moved between the raised and lowered positions to raise and lower, respectively, a drill string 108 through a borehole. Further, rotary head 107 is used to rotate drill string 108, wherein drill string 108 extends through tower 102. Drill string 108 generally includes one or more drill pipes connected together in a well-known manner. The drill pipes of drill string 108 are capable of being attached to an earth bit, such as a tri-cone rotary earth bit. It should be noted that the operation of the rotary head and feed cable system is typically controlled by the operator in operator's cab 105.

In this embodiment, tower interface assembly 118 rotatably mounts tower 102 to platform 103. In particular, tower base 102*a* is rotatably mounted to tower interface assembly 118. In this way, tower 102 is rotatably mounted to platform 103 through tower interface assembly 118. Tower interface assembly 118 is positioned proximate to platform front 101*c*. In particular, tower interface assembly 118 is positioned between platform front 101*c* and power pack 104.

In this embodiment, tower interface assembly 118 operatively couples platform 103 and tower 102 together. Tower 102 and platform 103 are operatively coupled together so that tower 102 can rotate relative to platform 103. In this way, tower interface assembly 118 provides an interface between tower 102 and platform 103.

Tower interface assembly 118 allows tower 102 to be repeatably moved between raised and lowered positions. In the lowered position, which is shown in FIG. 1*a*, tower crown 102*b* is towards platform 103, and a back 106*a* of tower 102 is towards platform 103 and prime mover 104. In the lowered position, tower 102 extends parallel to a reference line 111, which extends parallel to platform 103. It should also be noted that tower 102 is in a stowed condition when it is in the lowered position of FIG. 1*a*. Further, tower 102 is in a deployed condition when it is not in the lowered position of FIG. 1*a*.

In the raised position, which is shown in FIGS. 1*b* and 1*c*, a tower crown 102*b* of tower 102 is away from platform 103. In the raised position, a front 106*b* of tower 102 faces operator's cab 105 and back 106*a* of tower 102 faces prime mover 104. In the raised position, tower 102 extends parallel to a reference line 110, which extends perpendicular to platform 103 and reference line 111.

Tower interface assembly 118 allows tower 102 to be held at a desired predetermined angle relative to platform 103. Tower interface assembly 118 allows tower 102 to be held at the desired predetermined angle relative to platform 103 so that drilling machine 100 can be used for angled drilling. As will be discussed in more detail below, tower interface assembly 118 allows better control of the angle that tower 102 is tilted, and provides more stability to tower 102 when tower 102 is in a tilted condition.

It should be noted that tower 102 is in the tilted condition when it is positioned between the raised and lowered positions of FIGS. 1*a* and 1*b*, respectively, as indicated by a reference line 112. Reference line 112 extends at a non-zero angle θ relative to reference line 110. Reference line 112 extends parallel to tower 102 when tower 102 is rotatably mounted to tower interface assembly 118. Hence, reference line 112 is parallel to reference line 110 when tower 102 is in the raised position.

In this embodiment, drilling machine 100 includes tower actuators 117*a* and 117*b*, as shown in FIGS. 1*b* and 1*c*. Tower actuators 117*a* and 117*b* are operatively coupled between platform 103 and tower brackets 116*a* and 116*b*, respectively, of tower 102. Tower brackets 116*a* and 116*b* are shown in a perspective view in FIG. 1*f*, and can also be seen in FIGS. 1*a*, 1*b*, 1*c*, 1*d* and 1*e*.

In this embodiment, tower bracket 116*a* includes tower bracket lower opening 190*a*, tower bracket intermediate opening 191*a* and tower bracket upper opening 192*a*. Tower actuator 117*a* extends between platform 103 and tower bracket upper opening 192*a*. It should be noted that tower bracket intermediate opening 191*a* is positioned between tower bracket lower opening 190*a* and tower bracket upper opening 192*a*.

In this embodiment, tower bracket 116*b* includes tower bracket lower opening 190*b*, tower bracket intermediate opening 191*b* and tower bracket upper opening 192*b*. Tower actuator 117*b* extends between platform 103 and tower bracket upper opening 192*b*. It should be noted that tower bracket intermediate opening 191*b* is positioned between tower bracket lower opening 190*b* and tower bracket upper opening 192*b*.

Tower actuators 117*a* and 117*b* can be of many different types of actuators, such as hydraulic cylinders capable of being repeatably moved between extended and retracted positions. When tower actuators 117*a* and 117*b* are in the retracted position, tower 102 is in the lowered position, as shown in FIG. 1*a*. Further, when actuators 117*a* and 117*b* are in extended positions, tower 102 is in the raised position, as shown in FIGS. 1*b* and 1*c*. In this way, tower 102 is repeatably moveable between lowered and raised positions. It should be noted that the operation of tower actuators 117*a* and 117*b* is controlled by the operator in operator's cab 105. In this way, the movement of tower 102 between the raised and lowered conditions is controlled by the operator in operator's cab 105.

Figure 2A:
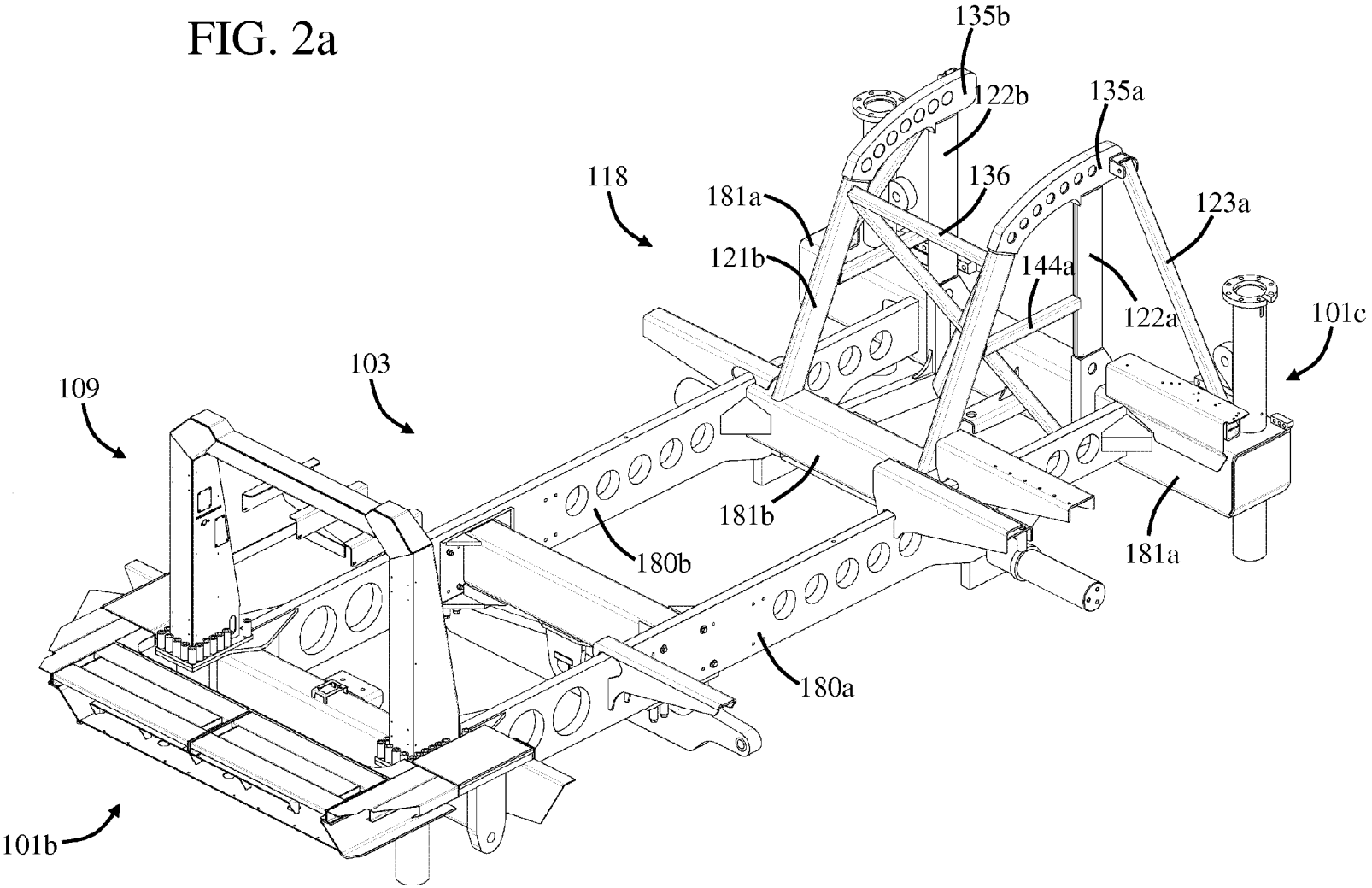
FIG. 2*a* is a rear perspective view of the tower interface assembly being carried by the platform, as shown in FIGS. 1*a*, 1*b* and 1*c*.
Figure 2B:
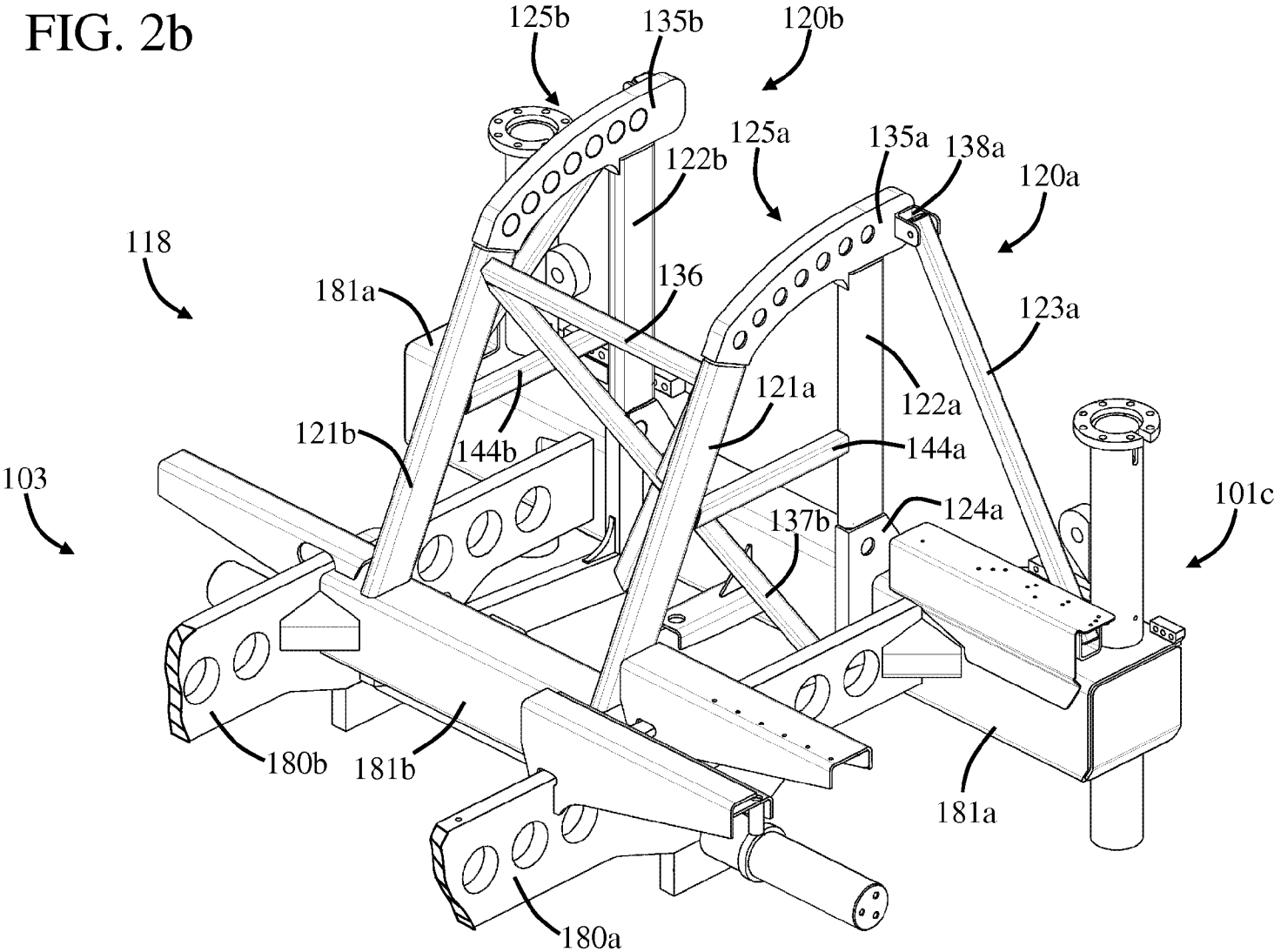
FIGS. 2*b* and 2*c* are close-up rear and front perspective views, respectively, of the tower interface assembly being carried by the platform, as shown in FIGS. 1*a*, 1*b* and 1*c*.
Figure 2C:
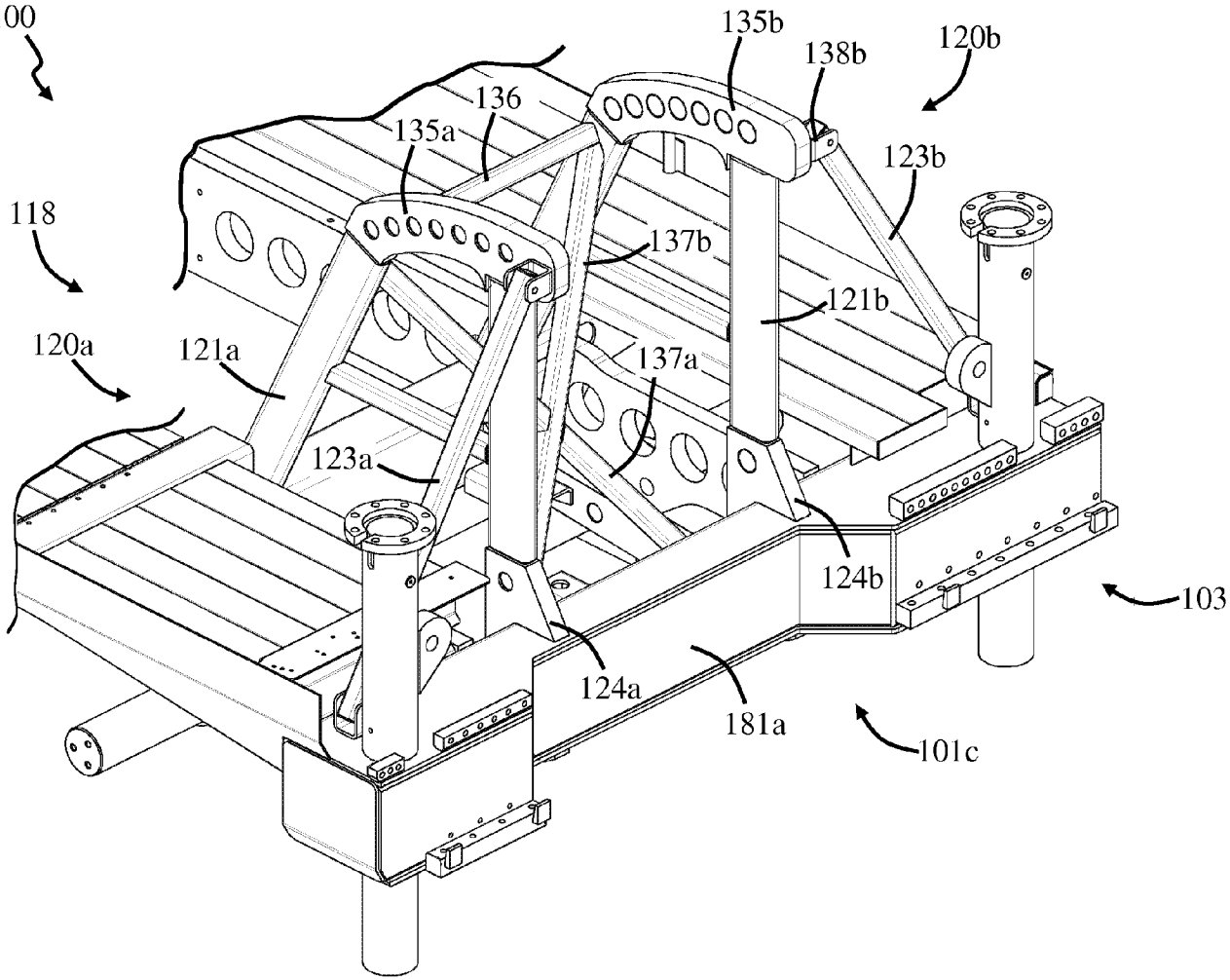
Figure 2D:
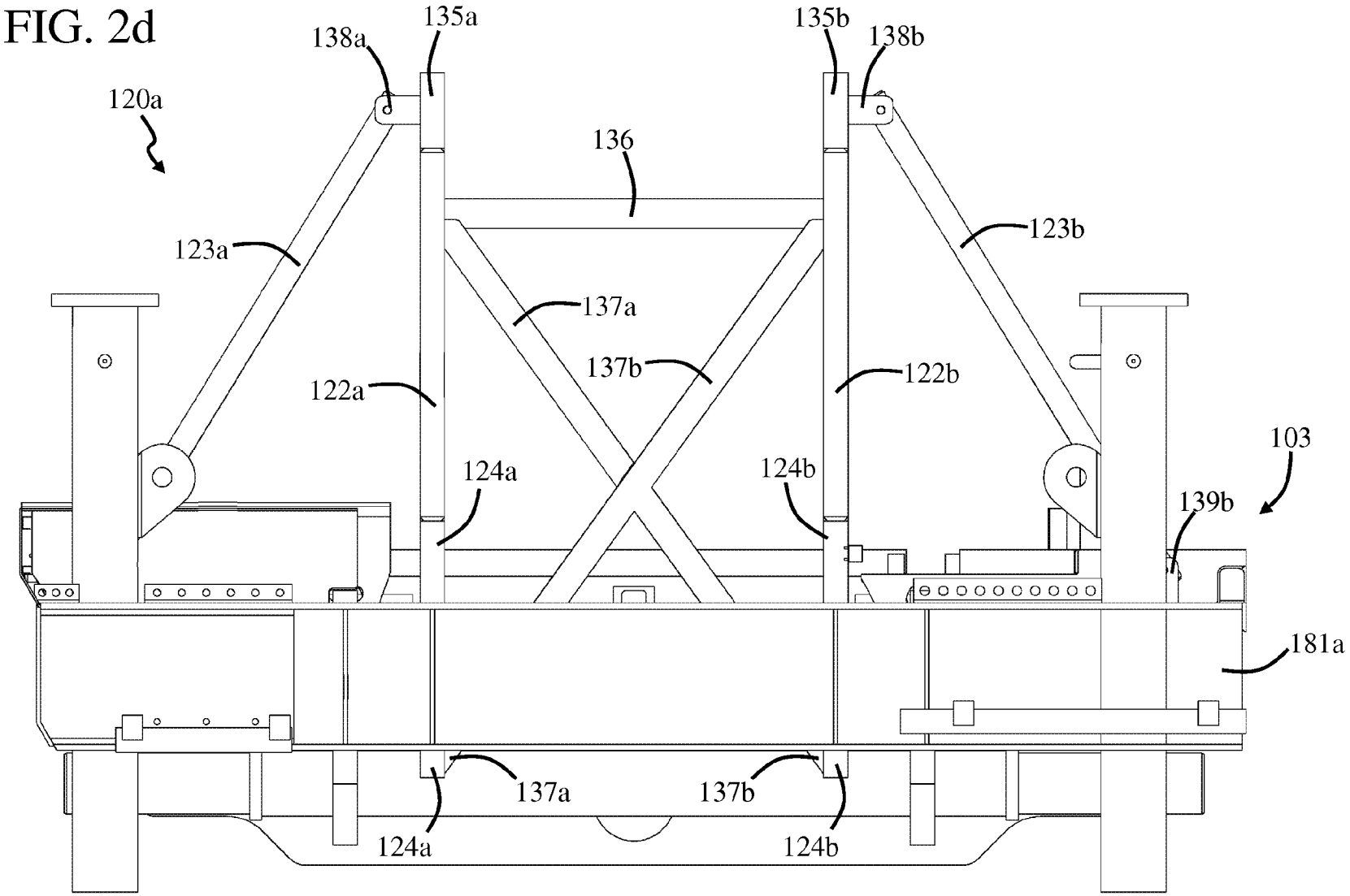
FIG. 2*d* is a front side view of the tower interface assembly being carried by the platform, as shown in FIGS. 1*a*, 1*b* and 1*c*.
Figure 2E:
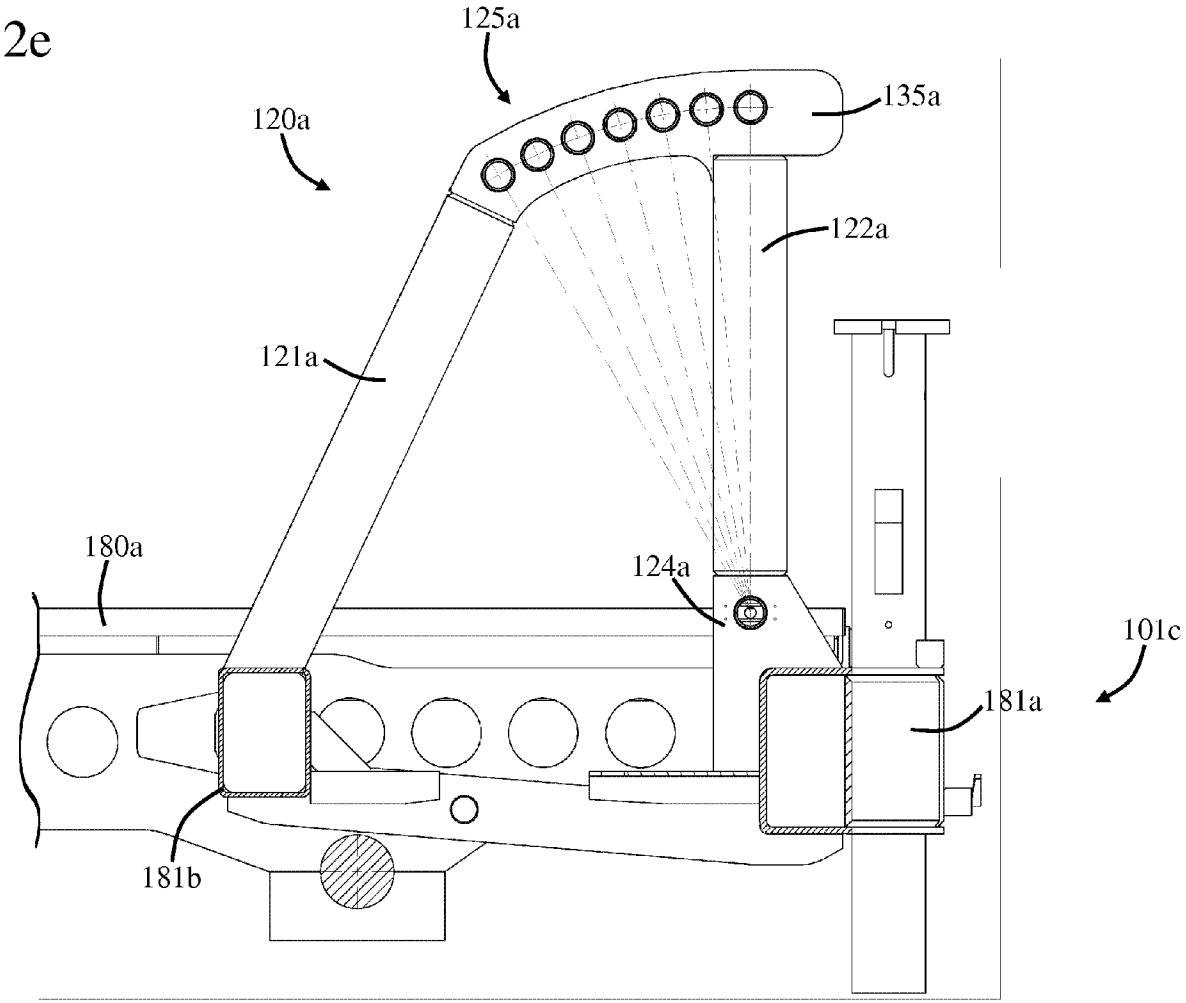
FIG. 2*e* is a side view of the tower interface assembly being carried by the platform, as shown in FIGS. 1*a*, 1*b* and 1*c*.
Figure 2F:
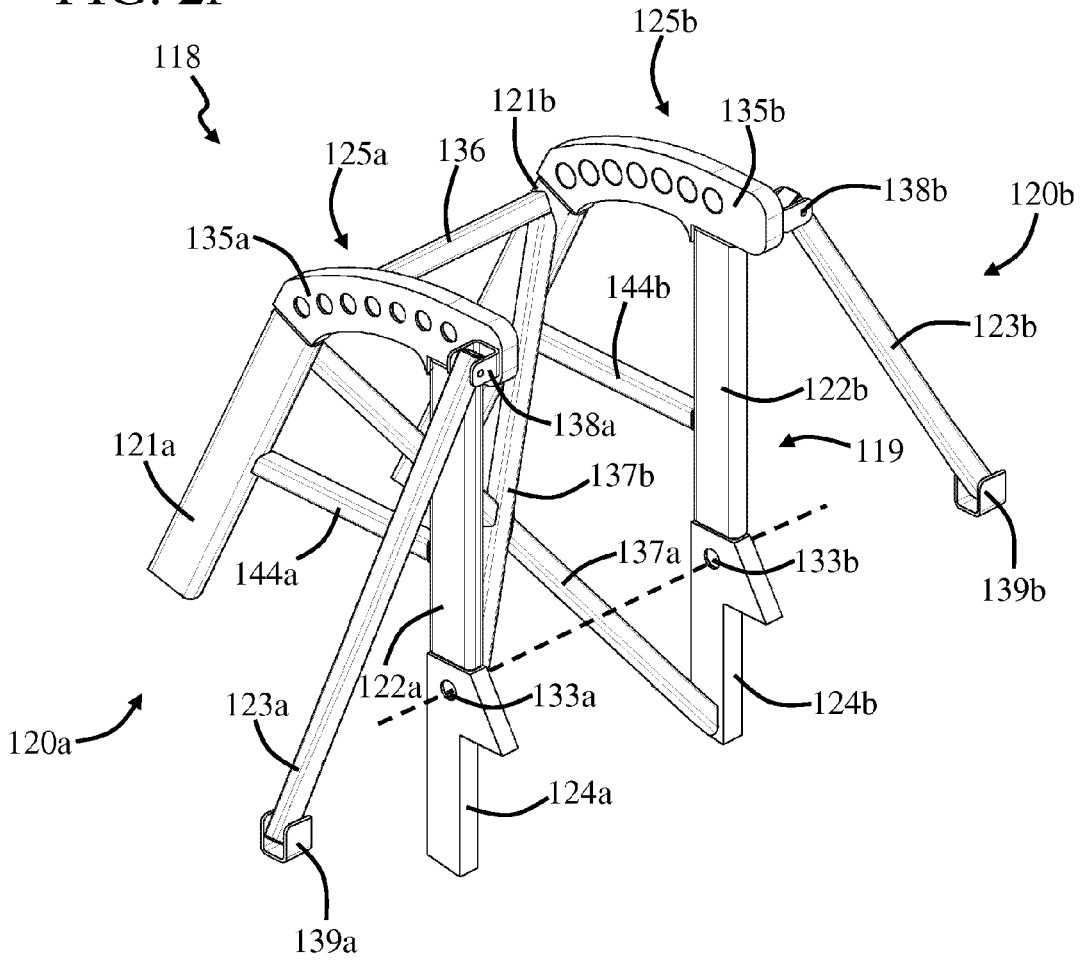
FIG. 2*f* is a front perspective view of the tower interface assembly of FIGS. 1*a*, 1*b* and 1*c*.

FIG. 2*a* is a rear perspective view of tower interface assembly 118 being carried by platform 103. FIGS. 2*b* and 2*c* are close-up rear and front perspective views, respectively, of tower interface assembly 118 being carried by platform 103. FIG. 2*d* is a front side view of tower interface assembly 118 being carried by platform 103. FIG. 2*e* is a side view of the tower interface assembly 118 being carried by the platform 103, and FIG. 2*f* is a front perspective view of tower interface assembly 118.

In this embodiment, platform 103 includes longitudinal platform beams 180*a* and 180*b*. Longitudinal platform beams 180*a* and 180*b* are longitudinal beams because they extend longitudinally between platform front 103*a* and vehicle back 101*b*. Longitudinal platform beams 180*a* and 180*b* provide support for the components of drilling machine 100, such as power pack 104 and a tower support cradle 109. Tower support cradle 109 is positioned proximate to vehicle back 101*b*, and holds tower 102 when tower 102 is in the stowed condition. Longitudinal platform beams 180*a* and 180*b* can be of many different types of beams, such as I beams.

In this embodiment, platform 103 includes forward platform cross beam 181*a* and intermediate platform cross beam 181*b* which extend between opposed longitudinal platform beams 180*a* and 180*b*. Forward platform cross beam 181*a* and intermediate platform cross beam 181*b* are cross beams because they extend transversely to longitudinal platform beams 180*a* and 180*b*. Forward platform cross beam 181*a* is a forward cross beam because it is positioned proximate to front 101*c* of platform 103. Intermediate platform cross beam 181*b* is an intermediate cross beam because it is positioned between forward platform cross beam 181*a* and vehicle back 101*b*. Further, intermediate platform cross beam 181*b* is an intermediate cross beam because forward platform cross beam 181*a* is positioned between front 101*c* of platform 103 and intermediate platform cross beam 181*b*.

As mentioned above, tower interface assembly 118 is positioned proximate to platform front 101*c*, and between platform front 101*c* and power pack 104. In this embodiment, tower interface assembly 118 is positioned proximate to forward platform cross beam 181*a* and intermediate platform cross beam 181*b*. In particular, tower interface assembly 118 is carried by forward platform cross beam 181*a* and intermediate platform cross beam 181*b*, as shown in FIGS. 2*a*, 2*b*, 2*c*, 2*d* and 2*e*.

In this embodiment, tower interface assembly 118 includes a tower support assembly 119 (FIG. 2*f*). Tower support assembly 119 is capable of holding tower 102 at the desired predetermined angle relative to platform 103, as will be discussed in more detail below. In this embodiment, tower support assembly 119 includes opposed angle bracket assemblies 120*a* and 120*b*. Angle bracket assembly 120*a* includes an angle bracket 121*a* coupled to forward platform cross beam 181*a*, and an angle bracket arm 135*a*. Angle bracket 121*a* extends upwardly towards vehicle front 101*c* and is coupled to angle bracket arm 135*a*. As will be discussed in more detail below, angle bracket arm 135*a* includes a plurality of angle pin sockets 125*a* which extend therethrough. The angle pin sockets of angle bracket arm 135*a* are positioned and spaced apart from each other so that tower 102 is held at the desired predetermined angle relative to platform 103.

In this embodiment, angle bracket assembly 120*a* includes an angle bracket support leg 122*a* which includes an angle bracket support leg base 124*a*. Angle bracket support leg base 124*a* includes a pivot pin socket 133*a*, which allows tower 102 to rotate relative to platform 102, as will be discussed in more detail below. Angle bracket support leg 122*a* is coupled to angle bracket arm 135*a*, and angle bracket support leg base 124*a* is coupled to forward platform cross beam 181*a*. Angle bracket 121*a* and angle bracket support leg 122*a* hold angle bracket arm 135*a* above longitudinal platform beam 180*a*.

In this embodiment, angle bracket assembly 120*b* includes an angle bracket 121*b* coupled to forward platform cross beam 181*b*, and an angle bracket arm 135*b*. Angle bracket 121*b* extends upwardly towards vehicle front 101*c* and is coupled to an angle bracket arm 135*b*. As will be discussed in more detail below, angle bracket arm 135*b* includes a plurality of angle pin sockets 125*b* which extend therethrough. The angle pin sockets of angle bracket arm 135*b* are positioned and spaced apart from each other so that tower 102 is held at the desired predetermined angle relative to platform 103.

In this embodiment, angle bracket assembly 120*b* includes an angle bracket support leg 122*b* which includes an angle bracket support leg base 124*b*. Angle bracket support leg base 124*b* includes a pivot pin socket 133*b*, which allows tower 102 to rotate relative to platform 102, as will be discussed in more detail below. Angle bracket support leg 122*b* is coupled to angle bracket arm 135*b*, and angle bracket support leg base 124*b* is coupled to forward platform cross beam 181*b*. Angle bracket 121*b* and angle bracket support leg 122*b* hold angle bracket arm 135*b* above longitudinal platform beam 180*b*.

In this embodiment, angle brackets 121*a* and 121*b* are positioned so they oppose each other. In this way, tower support assembly 119 includes opposed angle brackets. Further, angle bracket support legs 122*a* and 122*b* are positioned so they oppose each other. In this way, tower support assembly 119 includes opposed angle bracket support legs. Angle bracket support leg bases 124*a* and 124*b* are positioned so they oppose each other. In this way, tower support assembly 119 includes opposed angle bracket support leg bases. In this embodiment, angle bracket arm 135*a* and angle bracket arm 135*b* oppose each other. In this way, tower support assembly 119 includes opposed angle bracket arms. In this embodiment, angle pin sockets 125*a* and angle pin sockets 125*b* are positioned so they oppose each other. In this way, tower support assembly 119 includes opposed angle pin sockets.

It should be noted that, in some embodiments, angle bracket assembly 120*a* is a single integral piece, and angle bracket assembly 120*b* is a single integral piece. However, opposed angle bracket assemblies 120*a* and 120*b* are shown here as each including multiple pieces coupled together for illustrative purposes.

In some embodiments, tower interface assembly 118 includes components which provide support to tower support assembly 119. The components which provide support to tower support assembly 119 provide more stability to tower 102 when tower 102 is in a tilted condition.

In this embodiment, tower interface assembly 118 includes an angle bracket support arm 123*a* which provides support to angle bracket assembly 120*a*. Angle bracket support arm 123*a* is coupled at one end to longitudinal platform beam 180*a* through a support arm bracket 139*a* (FIG. 2*f*). Further, angle bracket support arm 123*a* is coupled at an opposed end to angle bracket arm 135*a* through a support arm bracket 138*a*. Angle bracket support arm 123*a* restricts the ability of angle bracket arm 135*a* to move towards and away from angle bracket assembly 120*b*.

In this embodiment, tower interface assembly 118 includes an angle bracket support arm 123*b* which provides support to angle bracket assembly 120*b*. Angle bracket support arm 123*b* is coupled at one end to longitudinal platform beam 180*b* through a support arm bracket 139*b* (FIG. 2*f*). Further, angle bracket support arm 123*b* is coupled at an opposed end to angle bracket arm 135*b* through a support arm bracket 138*b*. Angle bracket support arm 123*b* restricts the ability of angle bracket arm 135*b* to move towards and away from angle bracket assembly 120*a*.

In this embodiment, tower interface assembly 118 includes an angle bracket cross beam 136 which is coupled to angle bracket leg 121*a* and angle bracket leg 121*b*. Angle bracket cross beam 136 restricts the ability of angle bracket leg 121*a* and angle bracket leg 121*b* to move towards and away from each other.

In this embodiment, tower interface assembly 118 includes a longitudinal angle bracket beam 144*a* which is coupled to angle bracket leg 121*a* and angle bracket support leg 122*a*. Longitudinal angle bracket beam 144*a* restricts the ability of angle bracket leg 121*a* and angle bracket support leg 122*a* to move towards and away from each other.

In this embodiment, tower interface assembly 118 includes a longitudinal angle bracket beam 144*b* which is coupled to angle bracket leg 121*b* and angle bracket support leg 122*b*. Longitudinal angle bracket beam 144*b* restricts the ability of angle bracket leg 121*b* and angle bracket support leg 122*b* to move towards and away from each other.

In this embodiment, tower interface assembly 118 includes an angle bracket cross diagonal beam 137*a* which is coupled to angle bracket leg 121*a* and angle bracket support leg base 124*b*, as shown in FIGS. 2*d* and 2*f*. Angle bracket cross diagonal beam 137*a* restricts the ability of angle bracket assembly 120*a* and angle bracket assembly 120*b* to move towards and away from each other.

In this embodiment, tower interface assembly 118 includes an angle bracket cross diagonal beam 137*b* which is coupled to angle bracket leg 121*b* and angle bracket support leg base 124*a*, as shown in FIGS. 2*d* and 2*f*. Angle bracket cross diagonal beam 137*b* restricts the ability of angle bracket assembly 120*a* and angle bracket assembly 120*b* to move towards and away from each other.

Figure 3A:
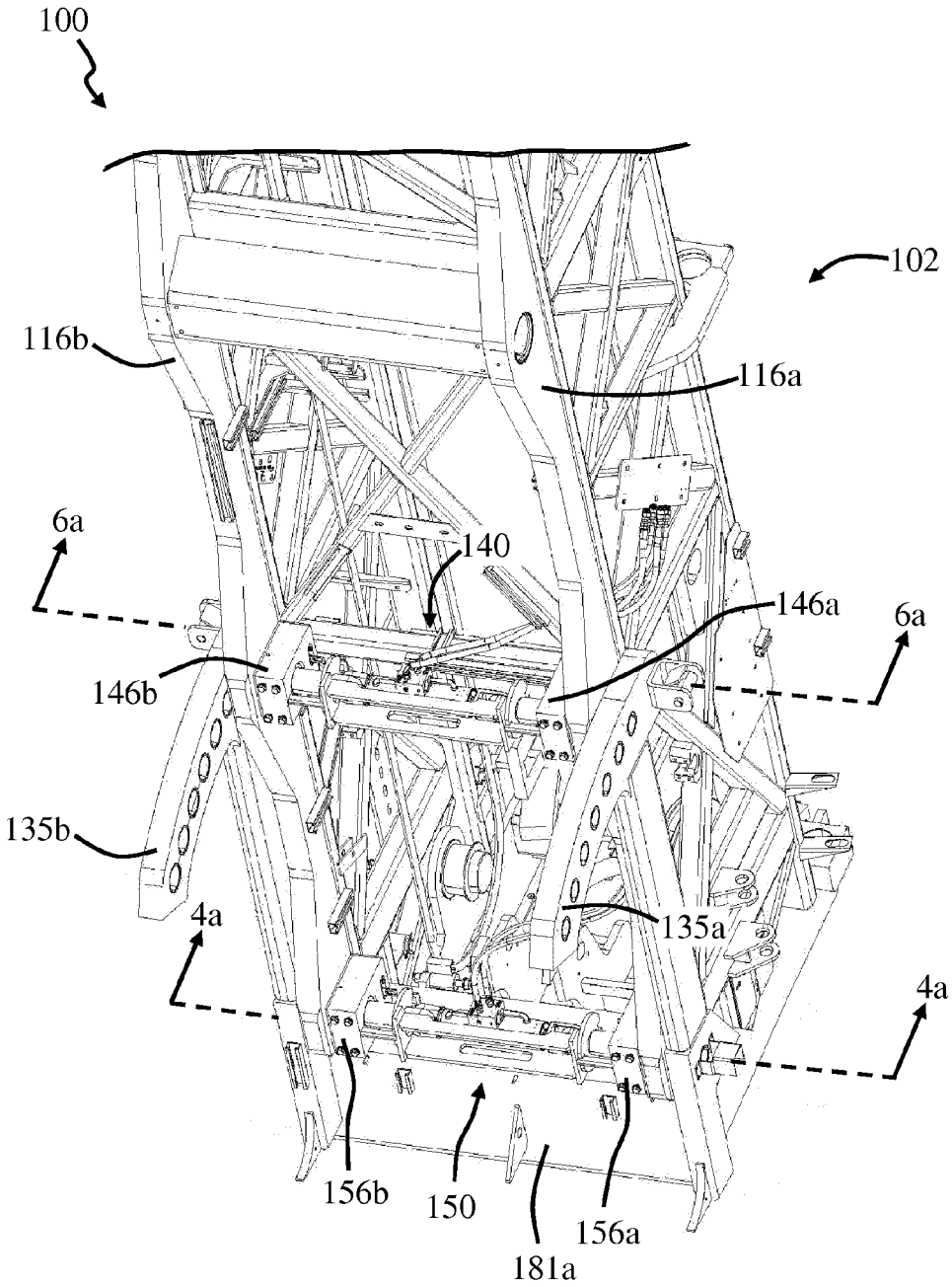
FIG. 3*a* is a close-up rear perspective view of the opposed tower brackets of FIG. 1*f* rotatably mounted to the tower interface assembly of the drilling machine of FIG. 1*a* with a pivot pin actuator and angle pin actuator, wherein the tower is in the raised condition.
Figure 3B:
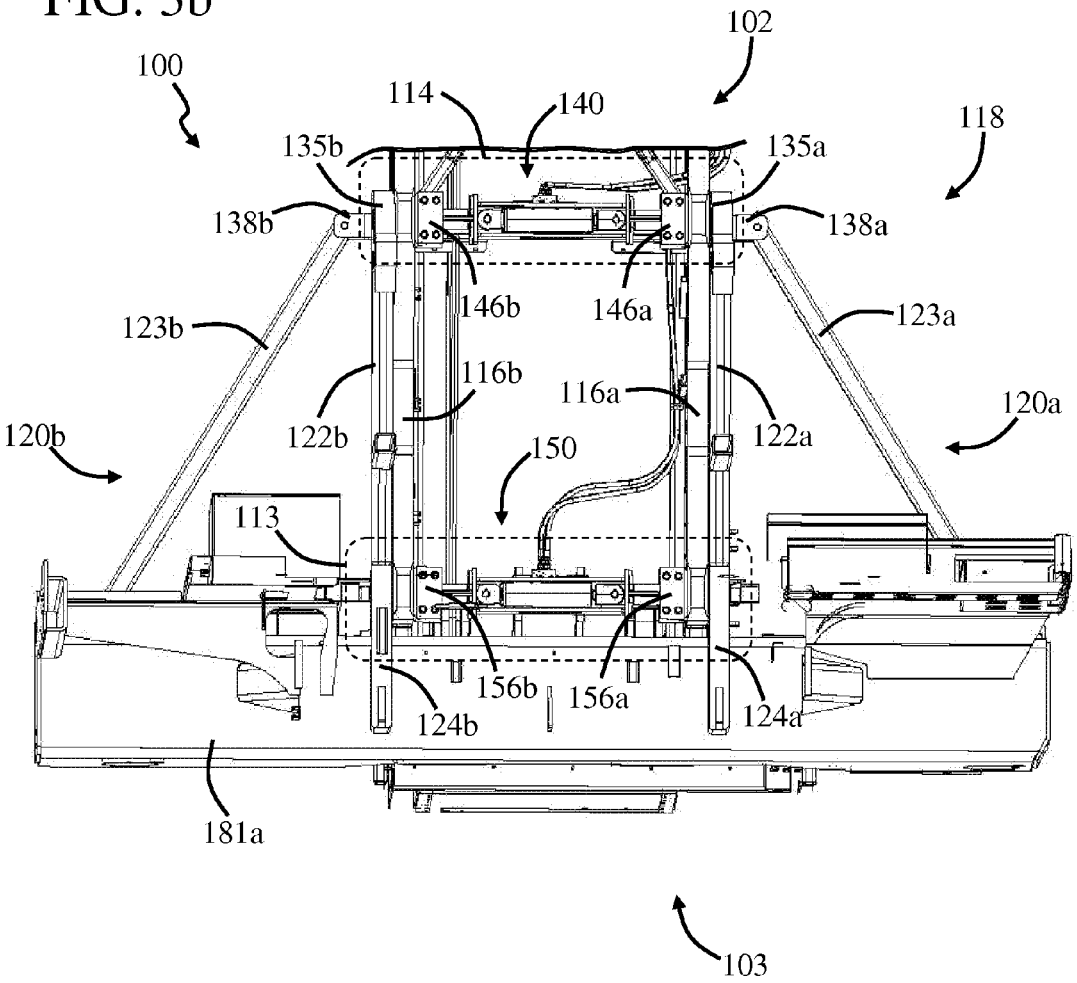
FIG. 3*b* is a close-up rear side view of the pivot pin actuator and angle pin actuator of FIG. 3*a*.

FIG. 3*a* is a close-up rear perspective view of opposed tower brackets 116*a* and 116*b* rotatably mounted to tower interface assembly 118 with a pivot pin actuator 150 and angle pin actuator 140, wherein tower 102 is in the raised condition. FIG. 3*b* is a close-up rear side view of pivot pin actuator 150 and angle pin actuator 140.

Pivot pin actuator 150 is positioned below angle pin actuator 140, and proximate to forward platform cross beam 181*a*, as shown in FIGS. 3*a* and 3*b*. Pivot pin actuator 150 extends between angle bracket assemblies 120*a* and 120*b*. In particular, pivot pin actuator 150 is positioned below angle pin actuator 140 so it extends between angle bracket support leg bases 124*a* and 124*b* and pivot pin sockets 133*a* and 133*b* (FIG. 2*f*).

Figure 1F:
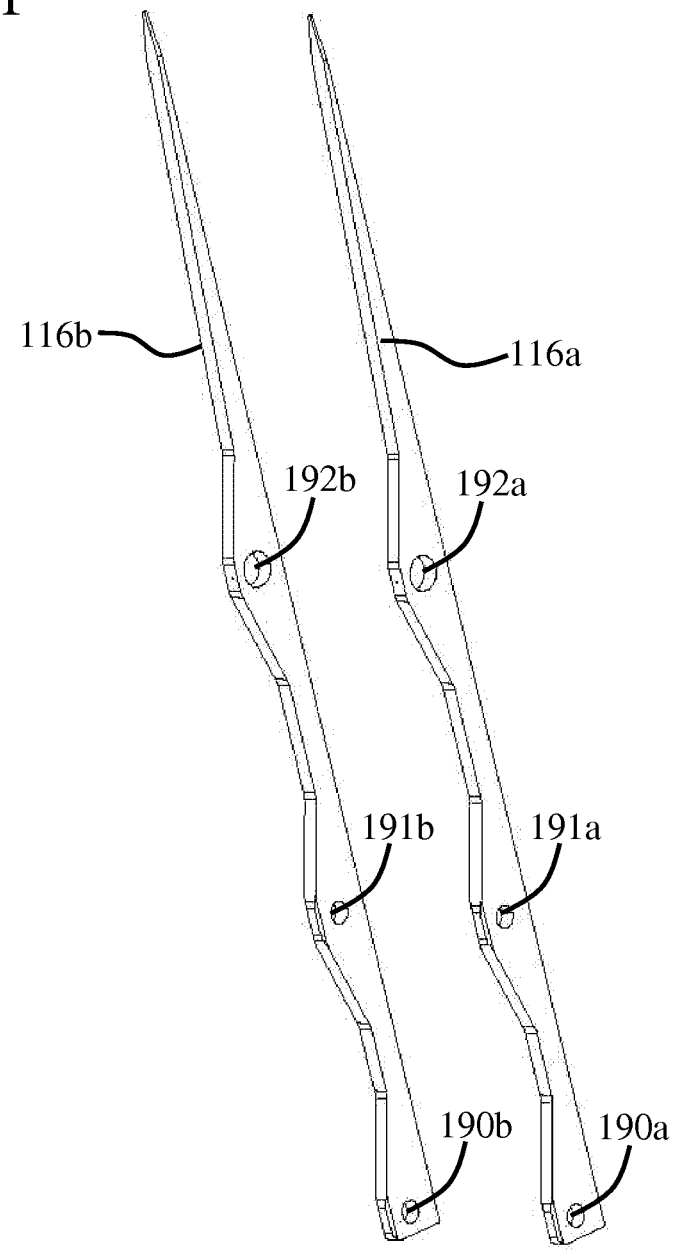
FIG. 1*f* is a perspective view of opposed tower brackets of the tower of the drilling machine of FIG. 1*a*.

In this embodiment, pivot pin actuator 150 is carried by tower brackets 116*a* and 116*b* (FIG. 1*f*). In particular, pivot pin actuator 150 is carried by tower brackets 116*a* and 116*b* so it extends between tower bracket lower openings 190*a* and 190*b*. As will be discussed in more detail below, pivot pin actuator 150 allows tower 102 to be coupled to tower interface assembly 118 so it can rotate relative to platform 103 and move between the raised and lowered positions.

Pivot pin actuator 150 is repeatably moveable between extended and retracted conditions. In the extended condition, and as discussed in more detail below, pivot pin actuator 150 extends through pivot pin sockets 133*a* and 133*b* (FIG. 2*f*) and tower bracket lower openings 190*a* and 190*b* (FIG. 1*f*). Pivot pin actuator 150 extends through pivot pin sockets 133*a* and 133*b* in the extended condition so that tower 102 can rotate relative to tower interface assembly 118. In this embodiment, movement of pivot pin actuator 150 between the extended and retracted conditions is controlled by the operator in operator's cab 105.

In the retracted condition, and as discussed in more detail below, pivot pin actuator 150 does not extend through pivot pin sockets 133*a* and 133*b* (FIG. 2*f*). Pivot pin actuator 150 does not extend through pivot pin sockets 133*a* and 133*b* in the retracted condition so that tower 102 can be moved relative to tower interface assembly 118.

In this embodiment, angle pin actuator 140 is positioned above pivot pin actuator 150, and away from forward platform cross beam 181*a*, as shown in FIGS. 3*a* and 3*b*. Angle pin actuator 140 extends between angle bracket assemblies 120*a* and 120*b*. In particular, angle pin actuator 140 is positioned above pivot pin actuator 150 so it extends between angle bracket arms 135*a* and 135*b* and angle pin sockets 125*a* and 125*b*.

In this embodiment, angle pin actuator 140 is carried by tower brackets 116*a* and 116*b* (FIG. 1*f*). In particular, angle pin actuator 140 is carried by tower brackets 116*a* and 116*b* so it extends between tower bracket intermediate openings 191*a* and 191*b*. As will be discussed in more detail below, angle pin actuator 140 allows tower 102 to be coupled to tower interface assembly 118 so tower 102 can be held at the desired predetermined angle relative to platform 103. Tower interface assembly 118 and angle pin actuator 140 allow tower 102 to be held at the desired predetermined angle relative to platform 103 so that drilling machine 100 can be used for angled drilling.

Angle pin actuator 140 is repeatably moveable between extended and retracted conditions. In the extended condition, and as discussed in more detail below, angle pin actuator 140 extends through a selected one of angle pin sockets 125*a* (FIG. 2*f*) and tower bracket intermediate opening 190*a* (FIG.

1*f*). Further, in the extended condition, angle pin actuator 140 extends through a selected one of angle pin sockets 125*b* (FIG. 2*f*) and tower bracket intermediate opening 191*b* (FIG. 1*f*). It should be noted that, in the extended condition, angle pin actuator 140 extends through opposed sockets of angle pin sockets 125*a* and 125*b*. Angle pin actuator 140 extends through angle pin sockets 125*a* and 125*b* in the extended condition so that tower 102 is held at the desired predetermined angle relative to platform 103.

In the retracted condition, and as discussed in more detail below, angle pin actuator 140 does not extend through angle pin socket 125*a* (FIG. 2*f*). Further, in the retracted condition, angle pin actuator 140 does not extend through angle pin socket 125*b* (FIG. 2*f*). Angle pin actuator 140 does not extend through angle pin sockets 125*a* and 125*b* in the retracted condition so that tower 102 can be rotated and moved relative to tower interface assembly 118. In this embodiment, movement of angle pin actuator 140 between the extended and retracted conditions is controlled by the operator in operator's cab 105.

Figure 4A:
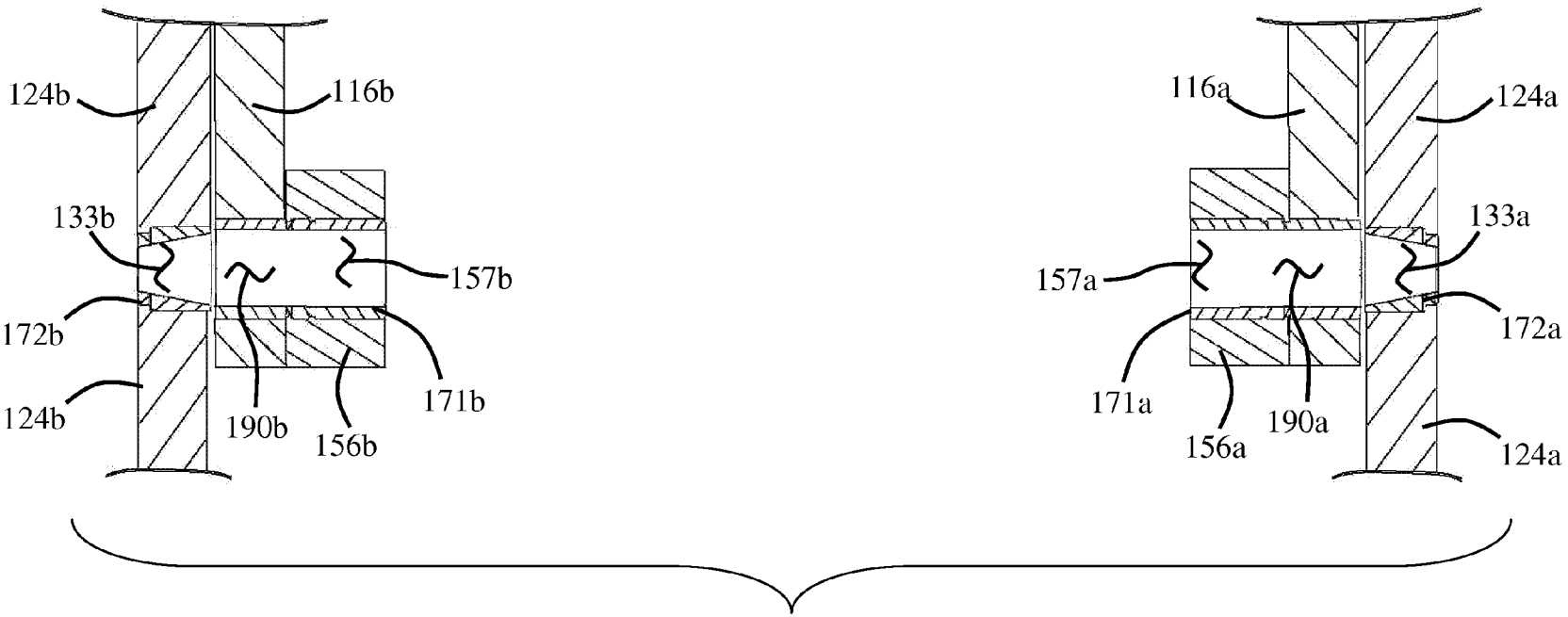
FIG. 4*a* is a sectional front view, taken along a cut-line 4*a*-4*a* of FIG. 3*a*, of the opposed tower brackets and tower interface assembly.

FIG. 4*a* is a sectional front view, taken along a cut-line 4*a*-4*a* of FIG. 3*a*, of opposed tower brackets 116*a* and 116*b* and tower interface assembly 118 in a region 113 of FIG. 3*b*. In this embodiment, mounting blocks 156*a* and 156*b* are mounted to opposed tower brackets 116*a* and 116*b*, respectively. Mounting block 156*a* includes a mounting block opening 157*a* which is aligned with tower bracket lower opening 190*a*. Further, mounting block 156*b* includes a mounting block opening 157*b* which is aligned with tower bracket lower opening 190*b*. Mounting blocks 156*a* and 156*b* are for holding pivot pin actuator 150 to opposed tower brackets 116*a* and 116*b*. As will be discussed in more detail below, pivot pin actuator 150 extends through mounting block openings 157*a* and 157*b*. In this way, pivot pin actuator 150 extends between opposed tower brackets 116*a* and 116*b*.

In this embodiment, a pivot pin insert 172*a* extends through pivot pin socket 133*a* of angle bracket support leg base 124*a*, and a pivot pin insert 172*b* extends through pivot pin socket 133*b* of angle bracket support leg base 124*b*. A pivot pin bushing 171*a* extends through tower bracket lower opening 190*a* of tower bracket 116*a* and mounting block openings 157*a* of mounting block 156*a*. Further, a pivot pin bushing 171*b* extends through tower bracket lower opening 190*b* of tower bracket 116*b* and mounting block openings 157*b* of mounting block 156*b*. Pivot pin insert 172*a*, pivot pin insert 172*b*, pivot pin bushing 171*a* and pivot pin bushing 171*b* each include central openings through which pivot pin actuator 150 moves in response to moving between the extended and retracted positions, as will be discussed below.

Mounting block openings 157*a* and 157*b* are repeatably moveable between aligned and unaligned positions with pivot pin sockets 133*a* and 133*b*, respectively. Mounting block openings 157*a* and 157*b* are repeatably moveable between aligned and unaligned positions with pivot pin sockets 133*a* and 133*b*, respectively, in response to moving tower 102 between the raised and lowered positions.

Mounting block openings 157*a* and 157*b* are aligned with pivot pin sockets 133*a* and 133*b*, respectively, when tower 102 is rotatably mounted to tower interface assembly 118. Mounting block openings 157*a* and 157*b* are unaligned with pivot pin sockets 133*a* and 133*b*, respectively, when tower 102 is not rotatably mounted to tower interface assembly 118. In particular, mounting block openings 157*a* and 157*b* are unaligned with pivot pin sockets 133*a* and 133*b*, respectively, when tower 102 is in the stowed condition of FIG. 1*a*. It should be noted that mounting block openings 157*a* and 157*b* are aligned with pivot pin sockets 133*a* and 133*b*, respectively, in FIG. 4*a*.

Tower bracket lower openings 190*a* and 190*b* are repeatably moveable between aligned and unaligned positions with pivot pin sockets 133*a* and 133*b*, respectively. Tower bracket lower openings 190*a* and 190*b* are repeatably moveable between aligned and unaligned positions with pivot pin sockets 133*a* and 133*b*, respectively, in response to moving tower 102 between the raised and lowered positions.

Tower bracket lower openings 190*a* and 190*b* are aligned with pivot pin sockets 133*a* and 133*b*, respectively, when tower 102 is rotatably mounted to tower interface assembly 118. Tower bracket lower openings 190*a* and 190*b* are unaligned with pivot pin sockets 133*a* and 133*b*, respectively, when tower 102 is not rotatably mounted to tower interface assembly 118. In particular, tower bracket lower openings 190*a* and 190*b* are unaligned with pivot pin sockets 133*a* and 133*b*, respectively, when tower 102 is in the stowed condition of FIG. 1*a*. It should be noted that tower bracket lower openings 190*a* and 190*b* are aligned with pivot pin sockets 133*a* and 133*b*, respectively, in FIG. 4*a*.

Figure 4B:
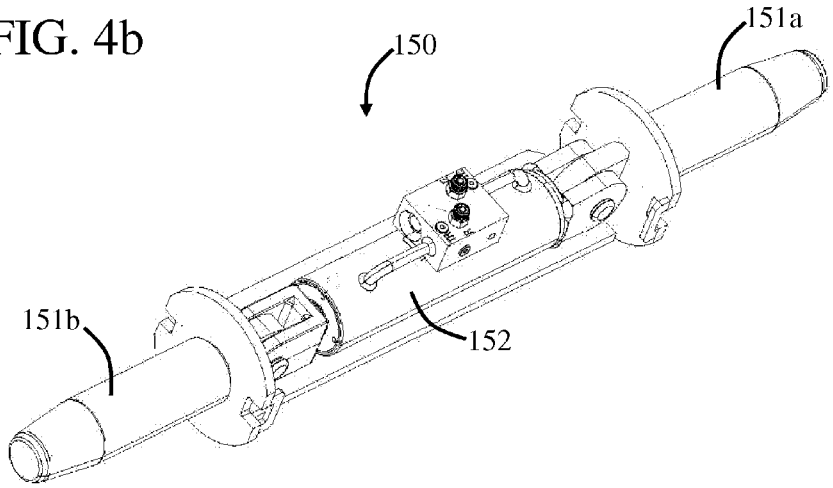
FIG. 4*b* is a perspective view of the pivot pin actuator of FIGS. 3*a* and 3*b*.

FIG. 4*b* is a perspective view of one embodiment of pivot pin actuator 150. In this embodiment, pivot pin actuator 150 includes a pivot pin cylinder 152, which is repeatably moveable between extended and retracted conditions. The movement of pivot pin cylinder 152 between the extended and retracted conditions is controlled by the operator in operator's cab 105. In this embodiment, pivot pin actuator 150 includes pivot pins 151*a* and 151*b*. Pivot pins 151*a* and 151*b* move away from and towards each other in response to moving pivot pin cylinder 152 between the extended and retracted conditions, respectively. In this way, pivot pin actuator 150 is repeatably moveable between extended and retracted conditions.

In this embodiment, pivot pins 151*a* and 151*b* are tapered pivot pins. More information regarding tapered pivot pins is provided in the above-identified related application. Tapered pivot pins are useful because they increase the likelihood that pivot pin actuator 150 will move from the retracted position to the extended position. For example, tapered pivot pins are useful because they increase the likelihood that pivot pin actuator 150 will move from the retracted position to the extended position in response to misalignment of pivot pin socket 133*a* and tower bracket lower opening 190*a*, and misalignment of pivot pin socket 133*b* and tower bracket lower opening 190*b*.

Figure 4C:
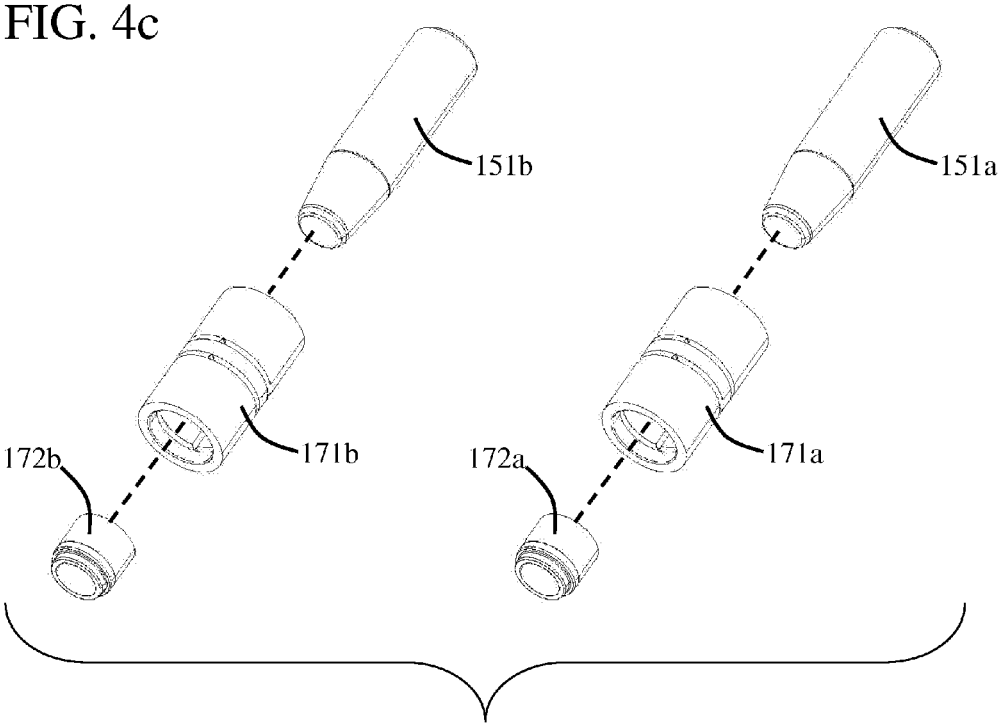
FIG. 4*c* is an exploded perspective view of a pivot pin of the pivot pin actuator of FIGS. 3*a* and 3*b*, and a pivot pin insert and pivot pin bushing of the tower.
Figure 4D:
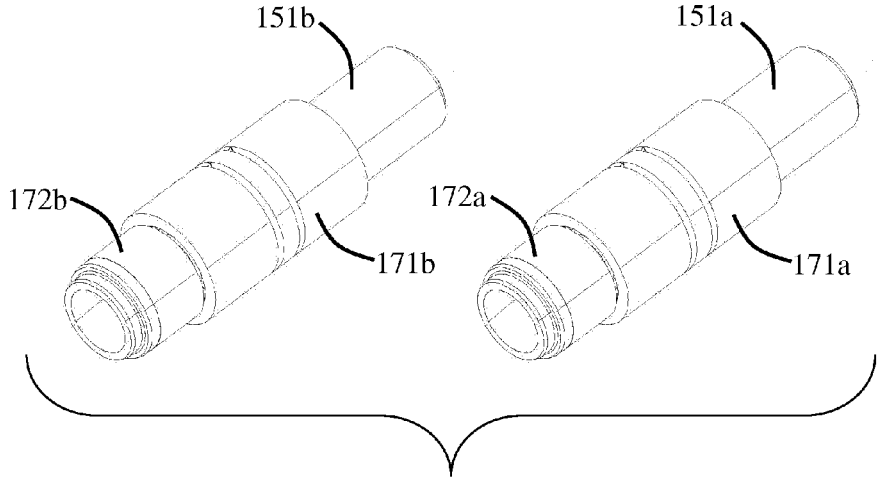
FIGS. 4*d* and 4*e* are perspective and side views, respectively, of the pivot pin of the pivot pin actuator of FIGS. 3*a* and 3*b*, and the pivot pin insert and pivot pin bushing of the tower.
Figure 4E:
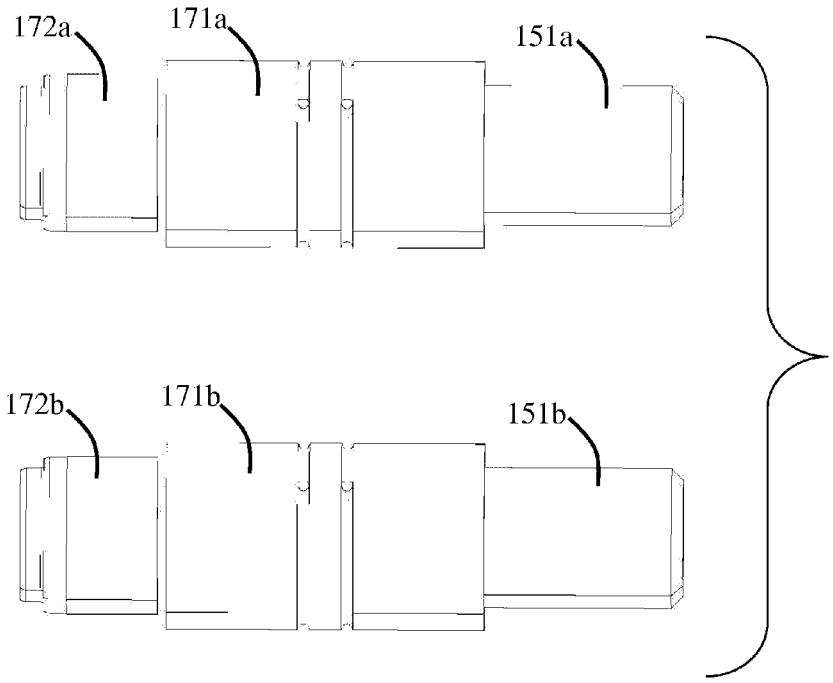

FIG. 4*c* is an exploded perspective view of pivot pins 151*a* and 151*b*, and pivot pin inserts 172*a* and 172*b* and pivot pin bushings 171*a* and 171*b*. FIGS. 4*d* and 4*e* are perspective and side views, respectively, of pivot pins 151*a* and 151*b*, and pivot pin inserts 172*a* and 172*b* and pivot pin bushings 171*a* and 171*b*.

It should be noted that, in the retracted condition, pivot pins 151*a* and 151*b* extend through pivot pin bushings 171*a* and 171*b*, respectively. Further, in the retracted condition, pivot pins 151*a* and 151*b* do not extend through pivot pin inserts 172*a* and 172*b*, respectively. In the retracted condition, pivot pins 151*a* and 151*b* do not extend through pivot pin inserts 172*a* and 172*b*, respectively, so that tower 102 can be moved between the raised and lowered positions.

In the extended condition, pivot pin 151*a* extends through pivot pin bushing 171*a* and pivot pin insert 172*a*, and pivot pin 151*b* extends through pivot pin bushing 171*b* and pivot pin insert 172*b*. In the extended condition, pivot pin 151*a* extends through pivot pin bushing 171*a* and pivot pin insert 172*a*, and pivot pin 151*b* extends through pivot pin bushing 171*b* and pivot pin insert 172*b* so that tower 102 is rotatably mounted to tower interface assembly 118.

Figure 5A:
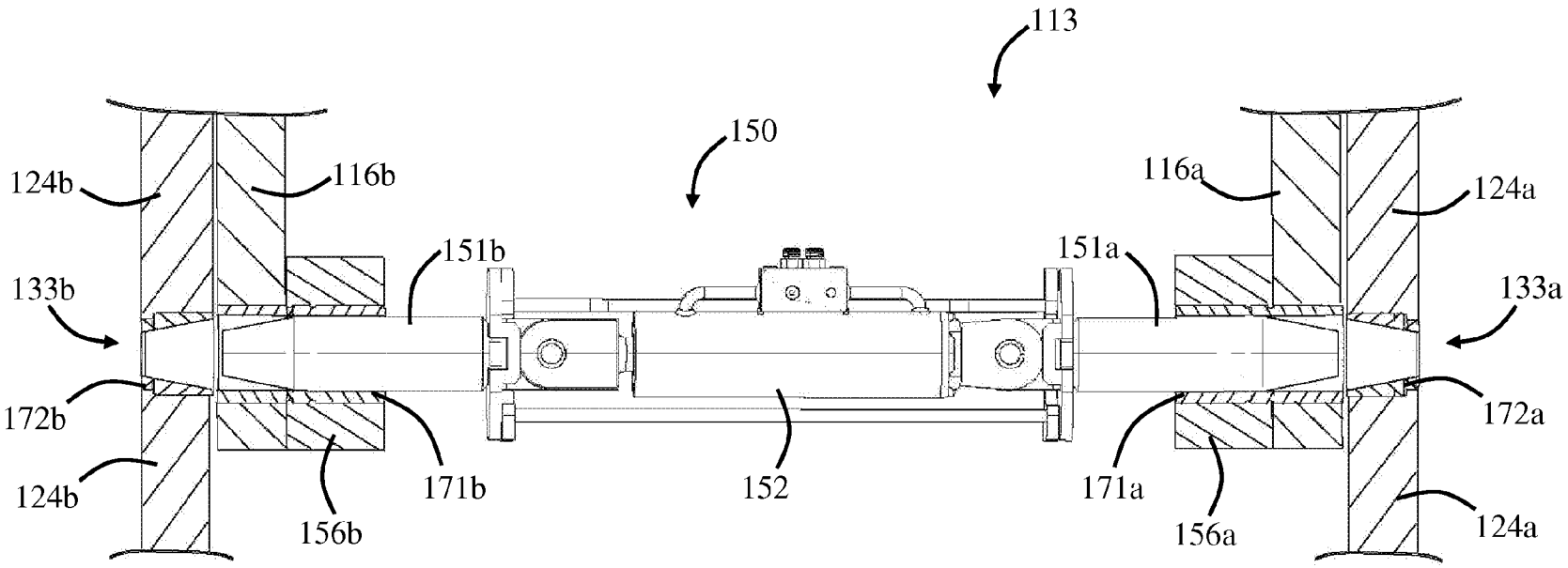
FIGS. 5*a* and 5*b* are views of the pivot pin actuator of FIGS. 3*a* and 3*b* in retracted and extended conditions, respectively.
Figure 5B:
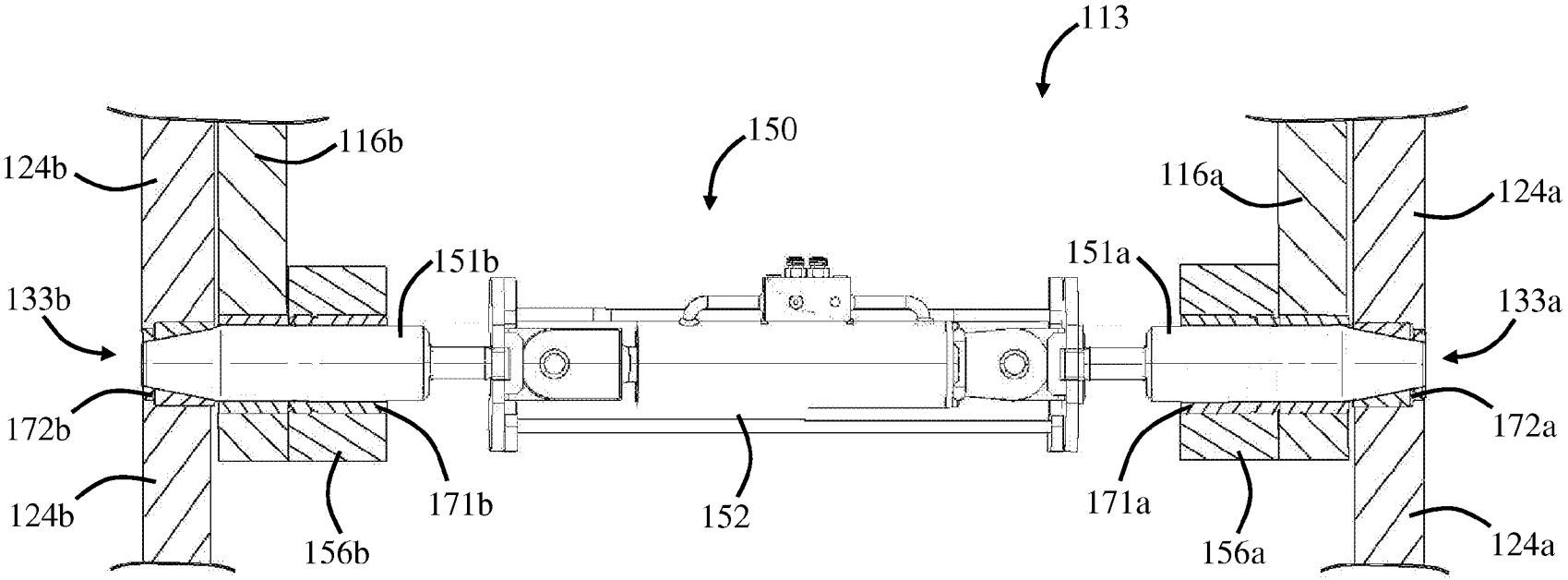

FIGS. 5*a* and 5*b* are views of pivot pin actuator 150 in retracted and extended conditions, respectively. It should be noted that the view of FIGS. 5*a* and 5*b* correspond with the view of FIG. 4*a*. In the retracted condition, pivot pin actuator 150 extends between pivot pin mounting blocks 156*a* and 156*b*, and extends through pivot pin mounting block openings 157*a* and 157*b*. In particular, pivot pins 151*a* and 151*b* extend through pivot pin mounting block openings 157*a* and 157*b*, respectively.

Further, in the retracted condition, pivot pin actuator 150 extends between tower brackets 116*a* and 116*b*, and extends through tower bracket lower openings 190*a* and 190*b*. In particular, pivot pins 151*a* and 151*b* extend through tower bracket lower openings 190*a* and 190*b*, respectively.

In the retracted condition, pivot pin actuator 150 does not extend through angle bracket support leg base 124*a* and 124*b*. In particular, pivot pins 151*a* and 151*b* do not extend through pivot pin sockets 133*a* and 133*b*, respectively. In the retracted condition, pivot pin actuator 150 does not extend through pivot pin sockets 133*a* and 133*b* so that tower 102 can be moved between the raised and lowered positions. It should be noted that tower 102 is not rotatably mounted to tower interface assembly 118 when pivot pin actuator 150 does not extend through pivot pin sockets 133*a* and 133*b*.

In the extended condition, pivot pin actuator 150 extends between pivot pin mounting blocks 156*a* and 156*b*, and extends through pivot pin mounting block openings 157*a* and 157*b*. In particular, pivot pins 151*a* and 151*b* extend through pivot pin mounting block openings 157*a* and 157*b*, respectively.

Further, in the extended condition, pivot pin actuator 150 extends between tower brackets 116*a* and 116*b*, and extends through tower bracket lower openings 190*a* and 190*b*. In particular, pivot pins 151*a* and 151*b* extend through tower bracket lower openings 190*a* and 190*b*, respectively.

In the extended condition, pivot pin actuator 150 extends through angle bracket support leg base 124*a* and 124*b*. In particular, pivot pins 151*a* and 151*b* extend through pivot pin sockets 133*a* and 133*b*, respectively. In the extended condition, pivot pin actuator 150 extends through pivot pin sockets 133*a* and 133*b* so that tower 102 is restricted from moving between the raised and lowered positions. It should be noted that tower 102 is rotatably mounted to tower interface assembly 118 when pivot pin actuator 150 extends through pivot pin sockets 133*a* and 133*b*. It should also be noted that tower 102 is moveable to a tilted condition when pivot pin actuator 150 extends through pivot pin sockets 133*a* and 133*b*, as will be discussed in more detail below.

As mentioned above, pivot pin actuator 150 is repeatably moveable between the extended and retracted conditions. Pivot pin 151*a* moves away from angle bracket support leg base 124*a* and pivot pin socket 133*a* in response to pivot pin actuator 150 moving to the retracted condition. Further, pivot pin 151*b* moves away from angle bracket support leg base 124*b* and pivot pin socket 133*b* in response to pivot pin actuator 150 moving to the retracted condition. Pivot pin 151*a* moves towards angle bracket support leg base 124*a* and pivot pin socket 133*a* in response to pivot pin actuator 150 moving to the extended condition. Further, pivot pin 151*b* moves towards angle bracket support leg base 124*b* and pivot pin socket 133*b* in response to pivot pin actuator 150 moving to the extended condition. Hence, pivot pins 151*a* and 151*b* are repeatably moveable towards and away from angle bracket support leg bases 124*a* and 124*b* in response to moving pivot pin actuator 150 between extended and retracted conditions, respectively. Further, pivot pins 151*a* and 151*b* are repeatably moveable towards and away from pivot pin sockets 133*b* and 133*b* in response to moving pivot pin actuator 150 between extended and retracted conditions, respectively.

Figure 6A:
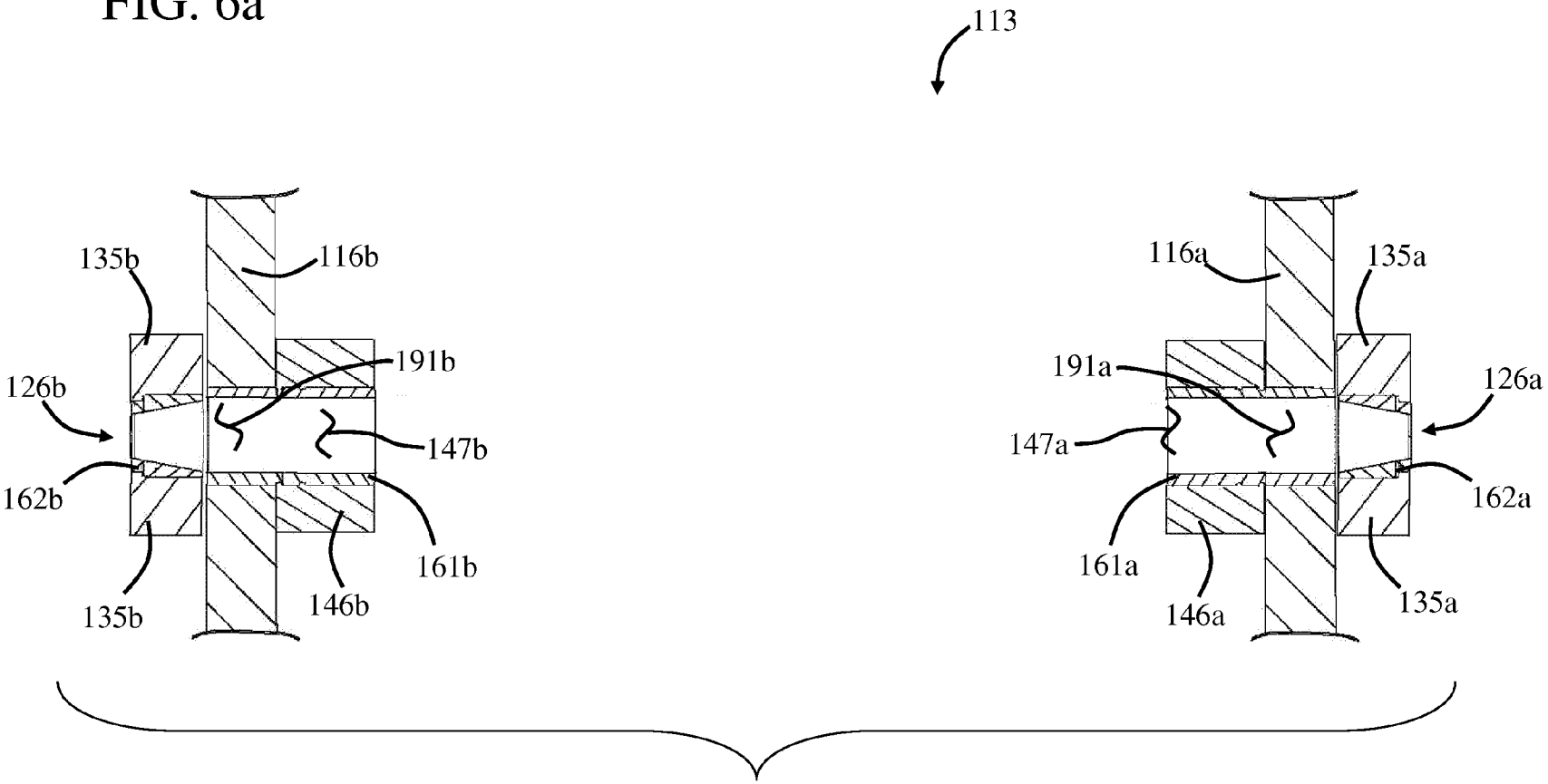
FIG. 6*a* is a sectional front view, taken along a cut-line 6*a*-6*a* of FIG. 3*a*, of the opposed tower brackets and tower interface assembly.

FIG. 6*a* is a sectional front view, taken along a cut-line 6*a*-6*a* of FIG. 3*a*, of opposed tower brackets 116*a* and 116*b* and tower interface assembly 118 in a region 114 of FIG. 3*b*. In this embodiment, mounting blocks 146*a* and 146*b* are mounted to opposed tower brackets 116*a* and 116*b*, respectively. Mounting block 146*a* includes a mounting block opening 147*a* which is aligned with tower bracket intermediate opening 191*a*. Further, mounting block 146*b* includes a mounting block opening 147*b* which is aligned with tower bracket intermediate opening 191*b*. Mounting blocks 146*a* and 146*b* are for holding angle pin actuator 140 to opposed tower brackets 116*a* and 116*b*. As will be discussed in more detail below, angle pin actuator 140 extends through mounting block openings 147*a* and 147*b*. In this way, angle pin actuator 140 extends between opposed tower brackets 116*a* and 116*b*.

In this embodiment, an angle pin insert 162*a* extends through an angle pin socket 126*a* of angle bracket arm 135*a*, and an angle pin insert 162*b* extends through angle pin socket 126*b* of angle bracket arm 135*b*. An angle pin bushing 161*a* extends through tower bracket intermediate opening 191*a* of tower bracket 116*a* and mounting block openings 147*a* of mounting block 146*a*. Further, an angle pin bushing 161*b* extends through tower bracket intermediate opening 191*b* of tower bracket 116*b* and mounting block openings 147*b* of mounting block 147*b*. Angle pin insert 162*a*, angle pin insert 162*b*, angle pin bushing 161*a* and angle pin bushing 161*b* each include central openings through which angle pin actuator 140 moves in response to moving between the extended and retracted positions, as will be discussed below.

Mounting block openings 147*a* and 147*b* are repeatably moveable between aligned and unaligned positions with angle pin sockets 126*a* and 126*b*, respectively. Mounting block openings 147*a* and 147*b* are repeatably moveable between aligned and unaligned positions with angle pin sockets 126*a* and 126*b*, respectively, in response to moving tower 102 between the raised and tilted positions. More information regarding moving tower 102 between the raised and tilted positions is provided below.

Mounting block openings 147*a* and 147*b* are aligned with angle pin sockets 126*a* and 126*b*, respectively, when tower 102 is rotatably mounted to tower interface assembly 118 and in the raised position of FIGS. 1*a* and 1*b*. Mounting block openings 147*a* and 147*b* are unaligned with angle pin sockets 126*a* and 126*b*, respectively, when tower 102 is rotatably mounted to tower interface assembly 118 and not in the upright position of FIGS. 1*a* and 1*b*. In particular, mounting block openings 147*a* and 147*b* are unaligned with angle pin sockets 126*a* and 126*b*, respectively, when tower 102 is in a tilted position. It should be noted that mounting block openings 147*a* and 147*b* are aligned with angle pin sockets 126*a* and 126*b*, respectively, in FIG. 6*a*.

Tower bracket intermediate openings 191*a* and 191*b* are repeatably moveable between aligned and unaligned positions with angle pin sockets 126*a* and 126*b*, respectively. Tower bracket intermediate openings 191*a* and 191*b* are repeatably moveable between aligned and unaligned positions with angle pin sockets 126*a* and 126*b*, respectively, in response to moving tower 102 between the raised and tilted positions.

Tower bracket intermediate openings 191*a* and 191*b* are aligned with angle pin sockets 126*a* and 126*b*, respectively, when tower 102 is rotatably mounted to tower interface assembly 118 and tower 102 is in the raised position. Tower bracket intermediate openings 191*a* and 191*b* are unaligned with angle pin sockets 126*a* and 126*b*, respectively, when tower 102 is rotatably mounted to tower interface assembly 118 and not in the raised position. It should be noted that tower bracket intermediate openings 191*a* and 191*b* are aligned with angle pin sockets 126*a* and 126*b*, respectively, in FIG. 6*a*.

Figure 6B:
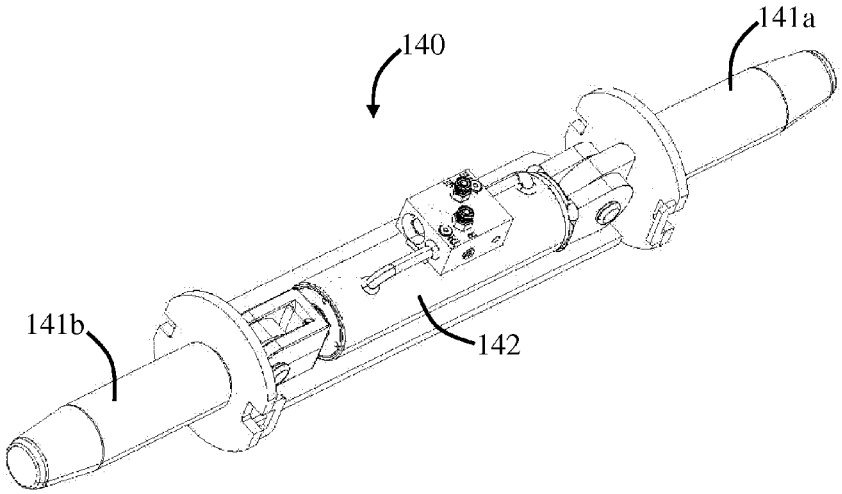
FIG. 6*b* is a perspective view of the angle pin actuator of FIGS. 3*a* and 3*b*.

FIG. 6*b* is a perspective view of one embodiment of angle pin actuator 140. In this embodiment, angle pin actuator 140 includes an angle pin cylinder 142, which is repeatably moveable between extended and retracted conditions. The movement of angle pin cylinder 142 between the extended and retracted conditions is controlled by the operator in operator's cab 105. In this embodiment, angle pin actuator 140 includes angle pins 141*a* and 141*b*. Angle pins 141*a* and 141*b* move away from and towards each other in response to moving angle pin cylinder 142 between the extended and retracted conditions, respectively. In this way, angle pin actuator 140 is repeatably moveable between extended and retracted conditions.

In this embodiment, angle pins 141*a* and 141*b* are tapered angle pins. More information regarding tapered angle pins is provided in the above-identified related application. Tapered angle pins are useful because they increase the likelihood that angle pin actuator 140 will move from the retracted position to the extended position. For example, tapered angle pins are useful because they increase the likelihood that angle pin actuator 140 will move from the retracted position to the extended position in response to misalignment of angle pin sockets 125*a* and tower bracket intermediate opening 191*a*, and misalignment of angle pin sockets 125*b* and tower bracket intermediate opening 191*b*.

Figure 6C:
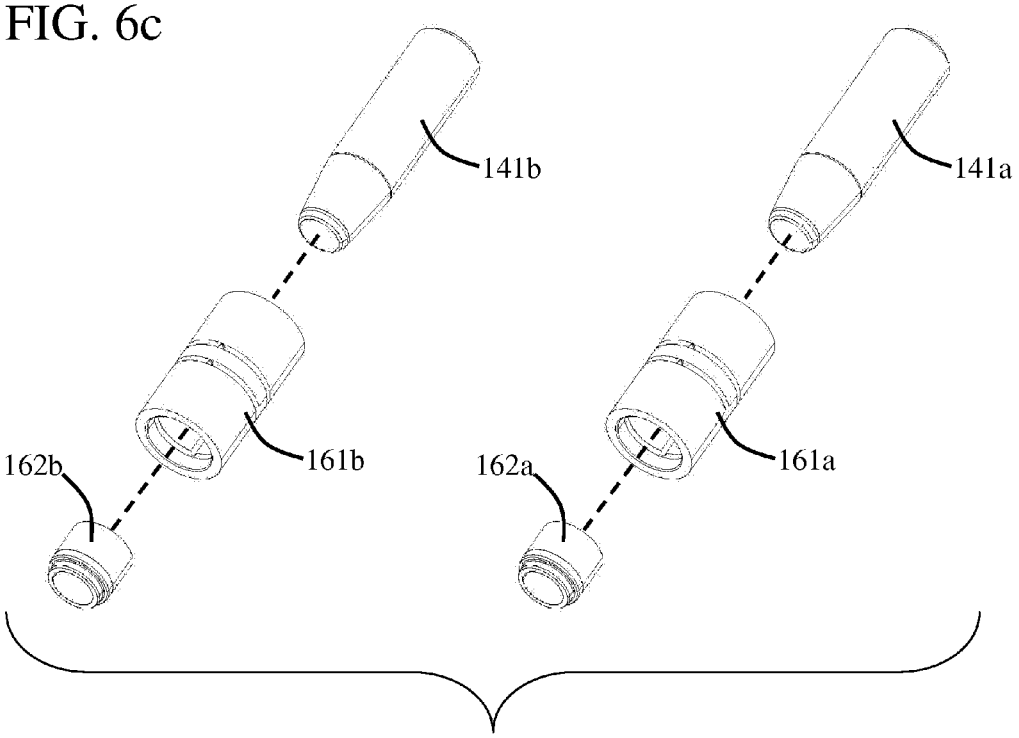
FIG. 6*c* is an exploded perspective view of an angle pin of the angle pin actuator of FIGS. 3*a* and 3*b*, and an angle pin insert and angle pin bushing of the tower.
Figure 6D:
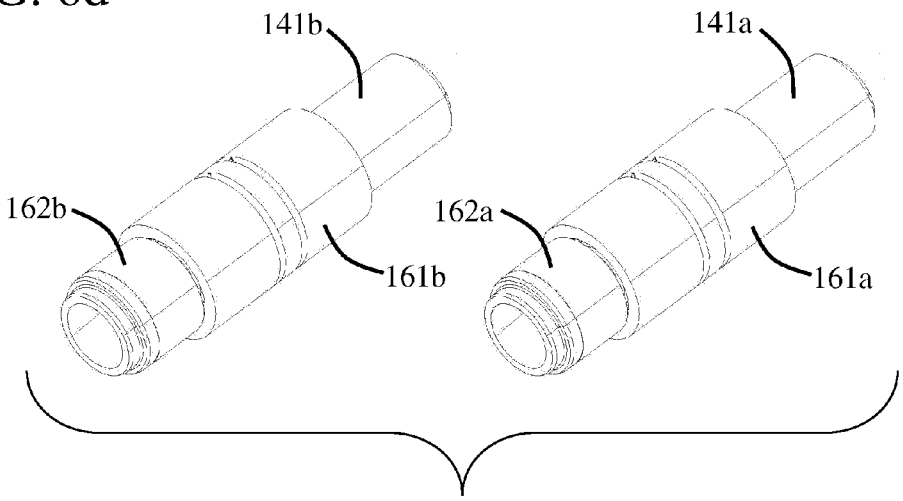
FIGS. 6*d* and 6*e* are perspective and side views, respectively, of the angle pin of the angle pin actuator of FIGS. 3*a* and 3*b*, and the angle pin insert and angle pin bushing of the tower.
Figure 6E:
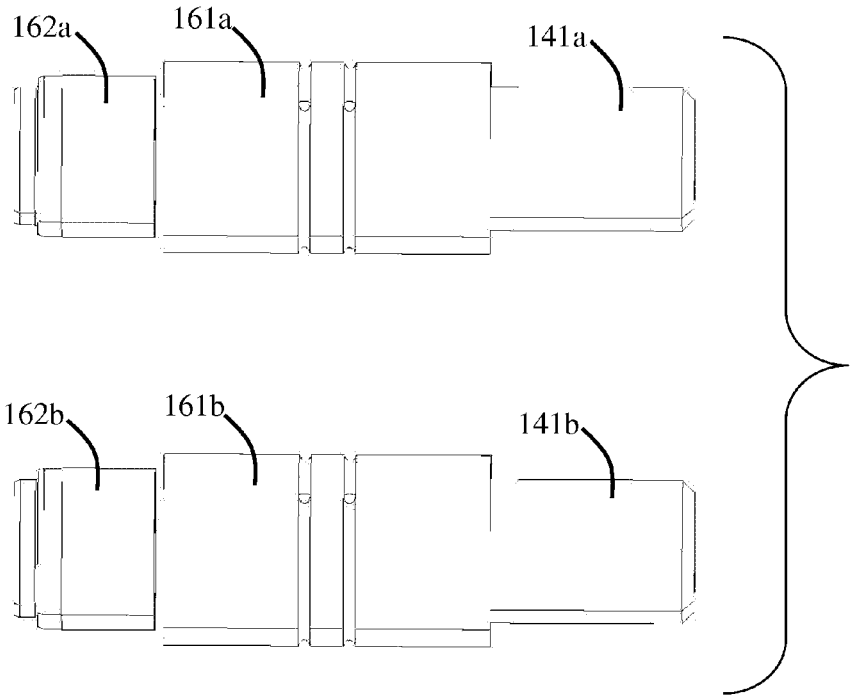

FIG. 6*c* is an exploded perspective view of angle pins 141*a* and 141*b*, and angle pin inserts 162*a* and 162*b* and angle pin bushings 161*a* and 161*b*. FIGS. 6*d* and 6*e* are perspective and side views, respectively, of angle pins 141*a* and 141*b*, and angle pin inserts 162*a* and 162*b* and angle pin bushings 161*a* and 161*b*.

It should be noted that, in the retracted condition, angle pins 141*a* and 141*b* extend through angle pin bushings 161*a* and 161*b*, respectively. Further, in the retracted condition, angle pins 161*a* and 161*b* do not extend through angle pin inserts 162*a* and 162*b*, respectively. In some situations, in the retracted condition, angle pins 161*a* and 161*b* do not extend through angle pin inserts 162*a* and 162*b*, respectively, so that tower 102 can be moved between the raised and lowered positions. In other situations, in the retracted condition, angle pins 161*a* and 161*b* do not extend through angle pin inserts 162*a* and 162*b*, respectively, so that tower 102 can be moved between tilted positions.

In the extended condition, angle pin 141*a* extends through angle pin bushing 161*a* and angle pin insert 162*a*, and angle pin 161*b* extends through angle pin bushing 161*b* and angle pin insert 162*b*. In the extended condition, angle pin 141*a* extends through angle pin bushing 161*a* and angle pin insert 162*a*, and angle pin 141*b* extends through angle pin bushing 161*b* and angle pin insert 162*b* so that tower 102 is held in the upright position.

Figure 7A:
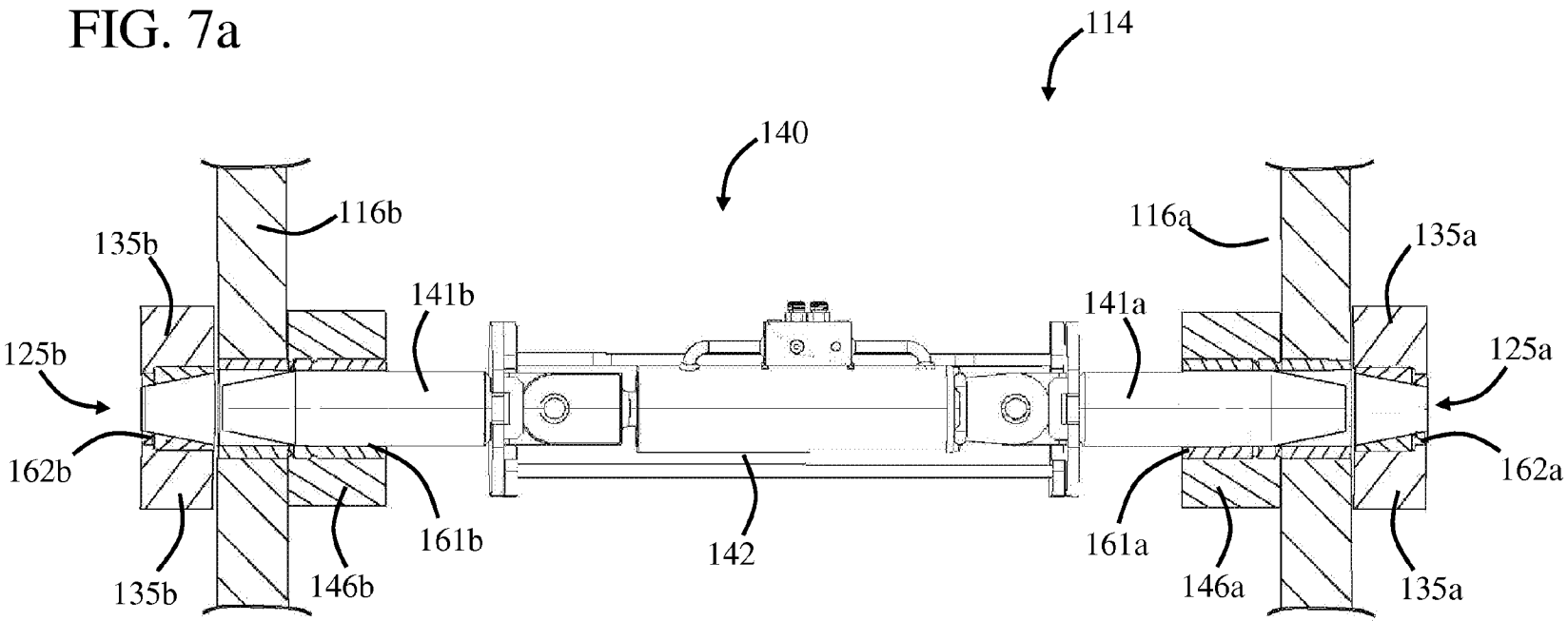
FIGS. 7*a* and 7*b* are views of the angle pin actuator of FIGS. 3*a* and 3*b* in retracted and extended conditions, respectively.
Figure 7B:
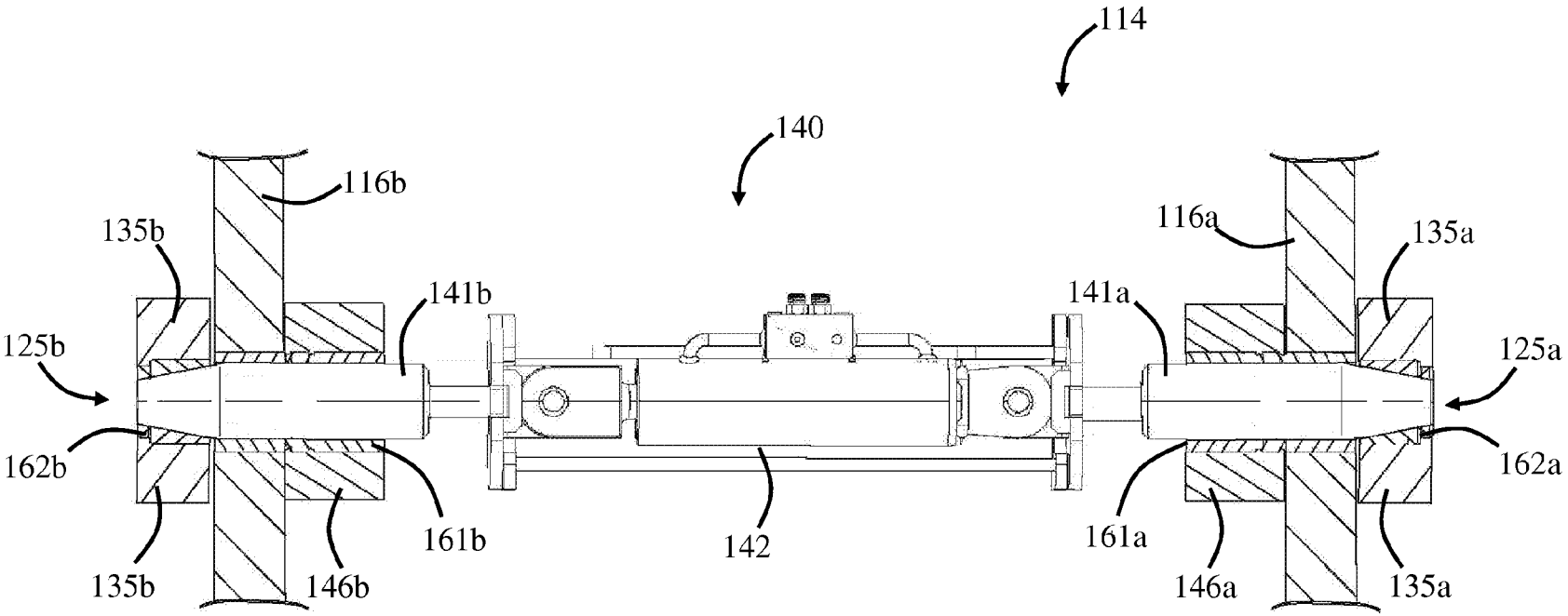

FIGS. 7*a* and 7*b* are views of angle pin actuator 140 in retracted and extended conditions, respectively. It should be noted that the view of FIGS. 7*a* and 7*b* correspond with the view of FIG. 6*a*. In the retracted condition, angle pin actuator 140 extends between angle pin mounting blocks 146*a* and 146*b*, and extends through angle pin mounting block openings 147*a* and 147*b*. In particular, angle pins 141*a* and 141*b* extend through angle pin mounting block openings 147*a* and 147*b*, respectively.

Further, in the retracted condition, angle pin actuator 140 extends between tower brackets 116*a* and 116*b*, and extends through tower bracket intermediate openings 191*a* and 191*b*. In particular, angle pins 141*a* and 141*b* extend through tower bracket intermediate openings 191*a* and 191*b*, respectively.

In the retracted condition, angle pin actuator 140 does not extend through angle bracket arms 135*a* and 135*b*. In particular, angle pins 141*a* and 141*b* do not extend through angle pin sockets 126*a* and 126*b*, respectively. It should be noted that pivot pins 151*a* and 151*b* do not extend through pivot pin sockets 133*a* and 133*b*, respectively, in the situations in which it is desirable to move tower 102 between the raised and lowered positions. However, angle pin actuator 140 does extend through angle pin sockets 126*a* and 126*b* so that tower 102 can be moved between the raised and lowered positions. Hence, tower 102 is rotatably mounted to tower interface assembly 118 through angle pin actuator 140 when tower 102 is moved to and from the stowed condition. In particular, tower 102 is rotatably mounted to tower interface assembly 118 through angle pins 141*a* and 141*b* when tower 102 is moved to and from the stowed condition (FIG. 1*a*). In this embodiment, angle pins 141*a* and 141*b* extend through angle pin sockets 126*a* and 126*b*, respectively, when tower 102 is moved to and from the stowed condition.

In other situations, in the retracted condition, angle pin actuator 140 does not extend through angle pin sockets 126*a* and 126*b* so that tower 102 can be moved between tilted positions. It should be noted that pivot pins 151*a* and 151*b* extend through pivot pin sockets 133*a* and 133*b*, respectively, in the situations in which it is desirable to move tower 102 between tilted positions.

In the extended condition, angle pin actuator 140 extends between angle pin mounting blocks 146*a* and 146*b*, and extends through angle pin mounting block openings 147*a* and 147*b*. In particular, angle pins 141*a* and 141*b* extend through angle pin mounting block openings 147*a* and 147*b*, respectively.

Further, in the extended condition, angle pin actuator 140 extends between tower brackets 116*a* and 116*b*, and extends through tower bracket intermediate openings 191*a* and 191*b*. In particular, angle pins 141*a* and 141*b* extend through tower bracket intermediate openings 191*a* and 191*b*, respectively.

In the extended condition, angle pin actuator 140 extends through angle bracket arms 135*a* and 135*b*. In particular, angle pins 141*a* and 141*b* extend through angle pin sockets 126*a* and 126*b*, respectively. In the extended condition, angle pin actuator 140 extends through angle pin sockets 126*a* and 126*b* so that tower 102 is held in the upright position.

As mentioned above, angle pin actuator 140 is repeatably moveable between the extended and retracted conditions. Angle pin 141*a* moves away from angle bracket arm 135*a* and angle pin socket 126*a* in response to angle pin actuator 140 moving to the retracted condition. Further, angle pin 141*b* moves away from angle bracket arm 135*b* and angle pin socket 126*b* in response to angle pin actuator 140 moving to the retracted condition. Angle pin 141*a* moves towards angle bracket arm 135*a* and angle pin socket 126*a* in response to angle pin actuator 140 moving to the extended condition. Further, angle pin 141*b* moves towards angle bracket arm 135*b* and angle pin socket 126*b* in response to angle pin actuator 140 moving to the extended condition. Hence, angle pins 141*a* and 141*b* are repeatably moveable towards and away from angle bracket arm 135*a* and 135*b* in response to moving angle pin actuator 140 between extended and retracted conditions, respectively. Further, angle pins 141*a* and 141*b* are repeatably moveable towards and away from angle pin sockets 126*b* and 126*b* in response to moving angle pin actuator 140 between extended and retracted conditions, respectively.

Figure 8A:
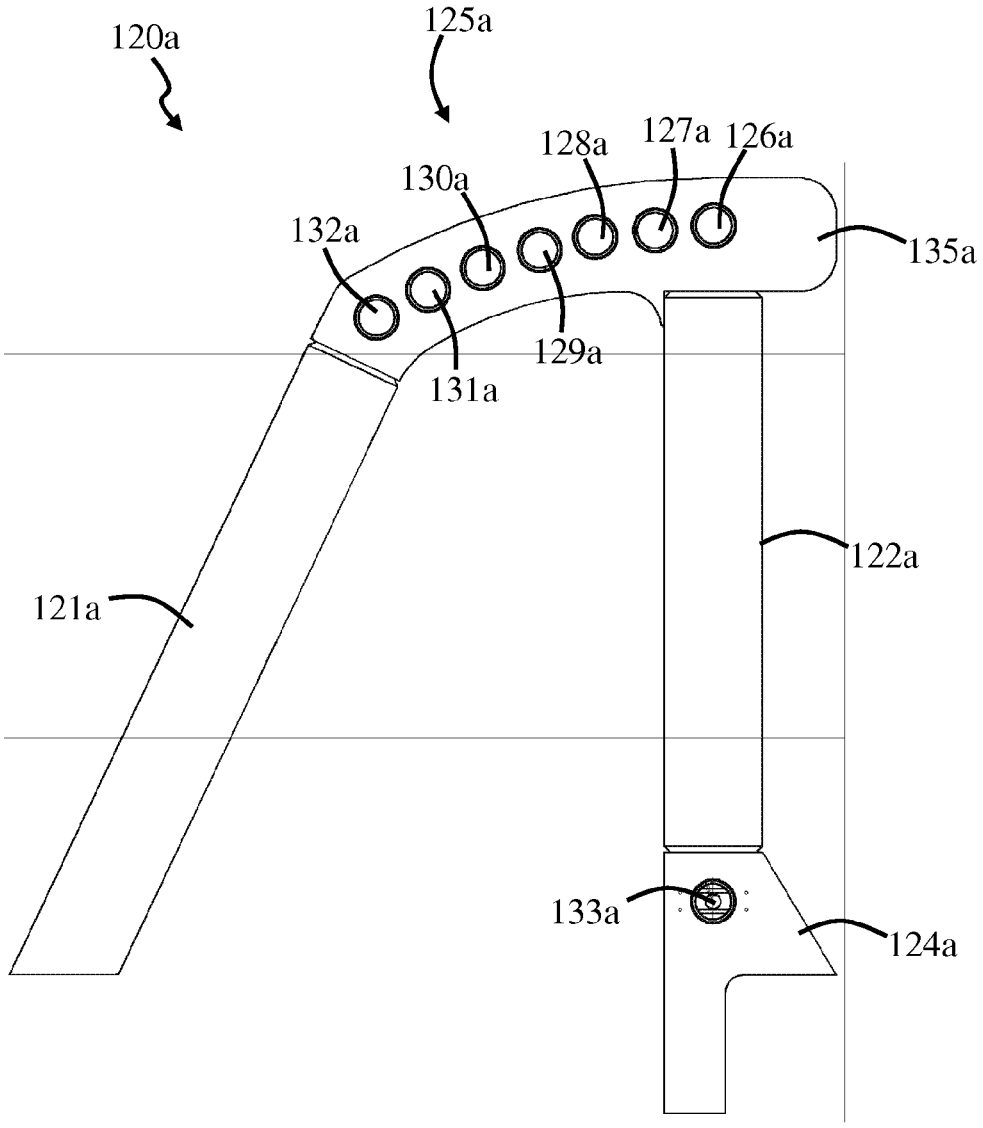
FIGS. 8*a*, 8*b*, 8*c* and 8*d* are side views of the opposed angle bracket assemblies of the tower interface assembly.
Figure 8B:
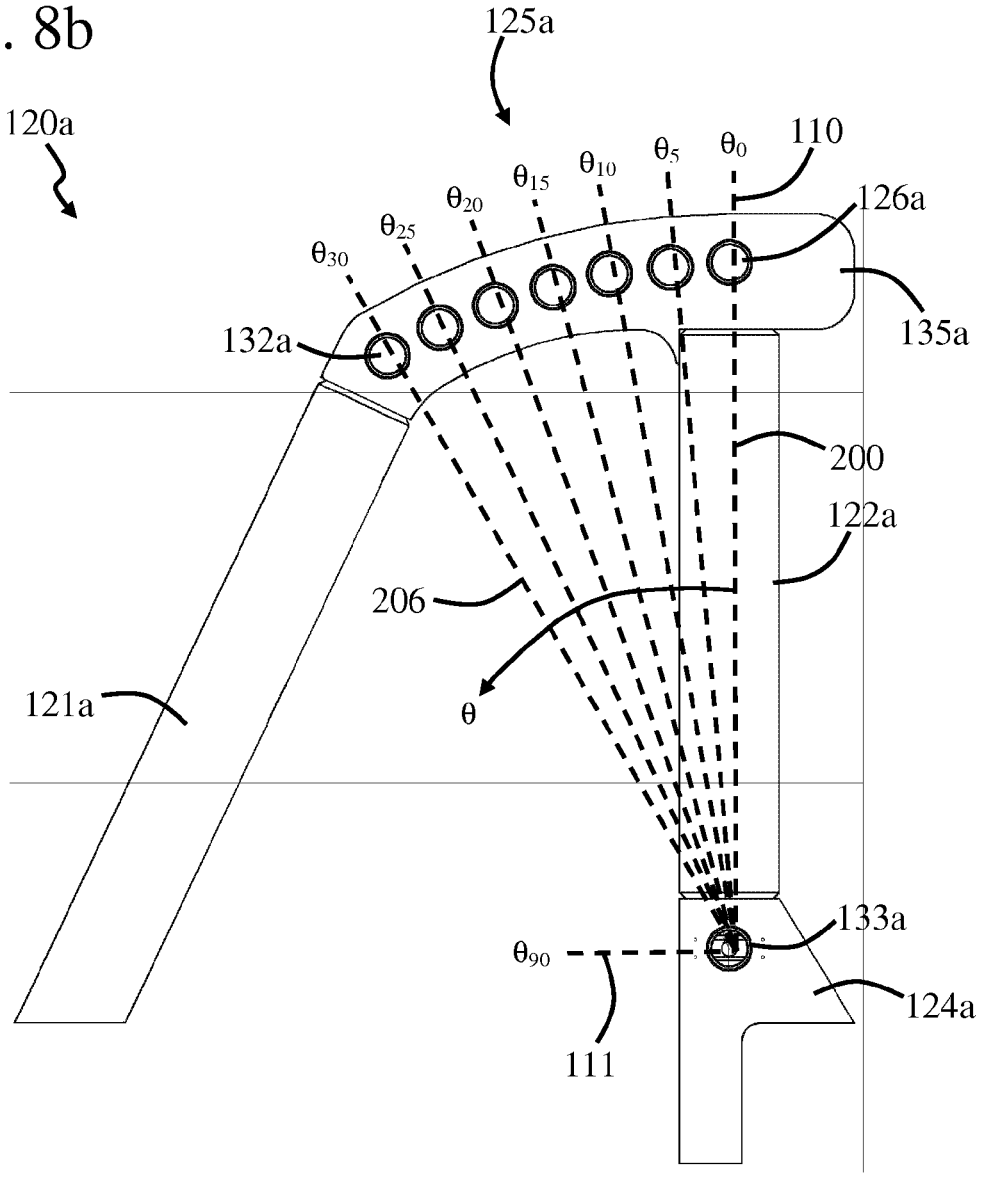
Figure 8C:
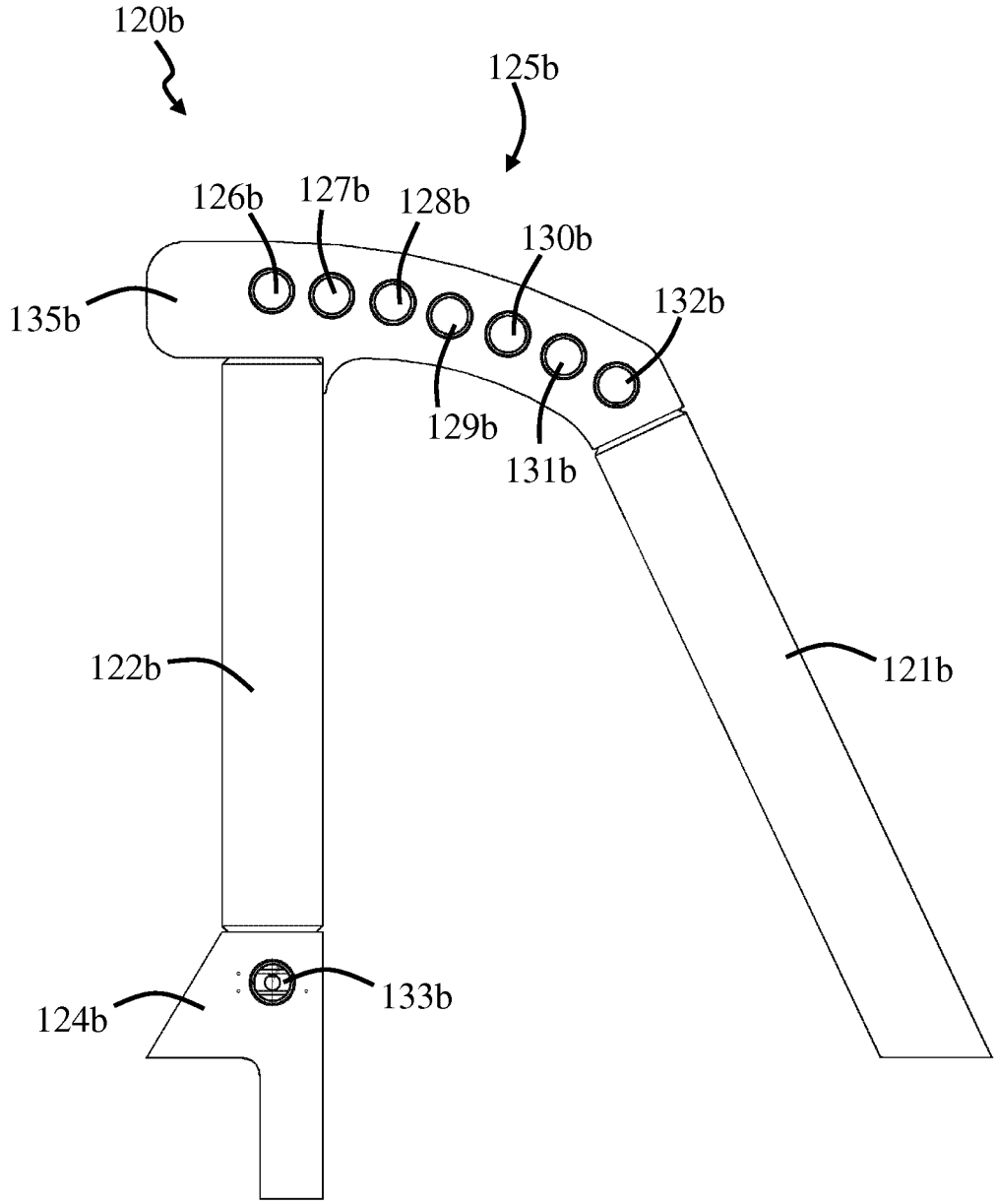
Figure 8D:
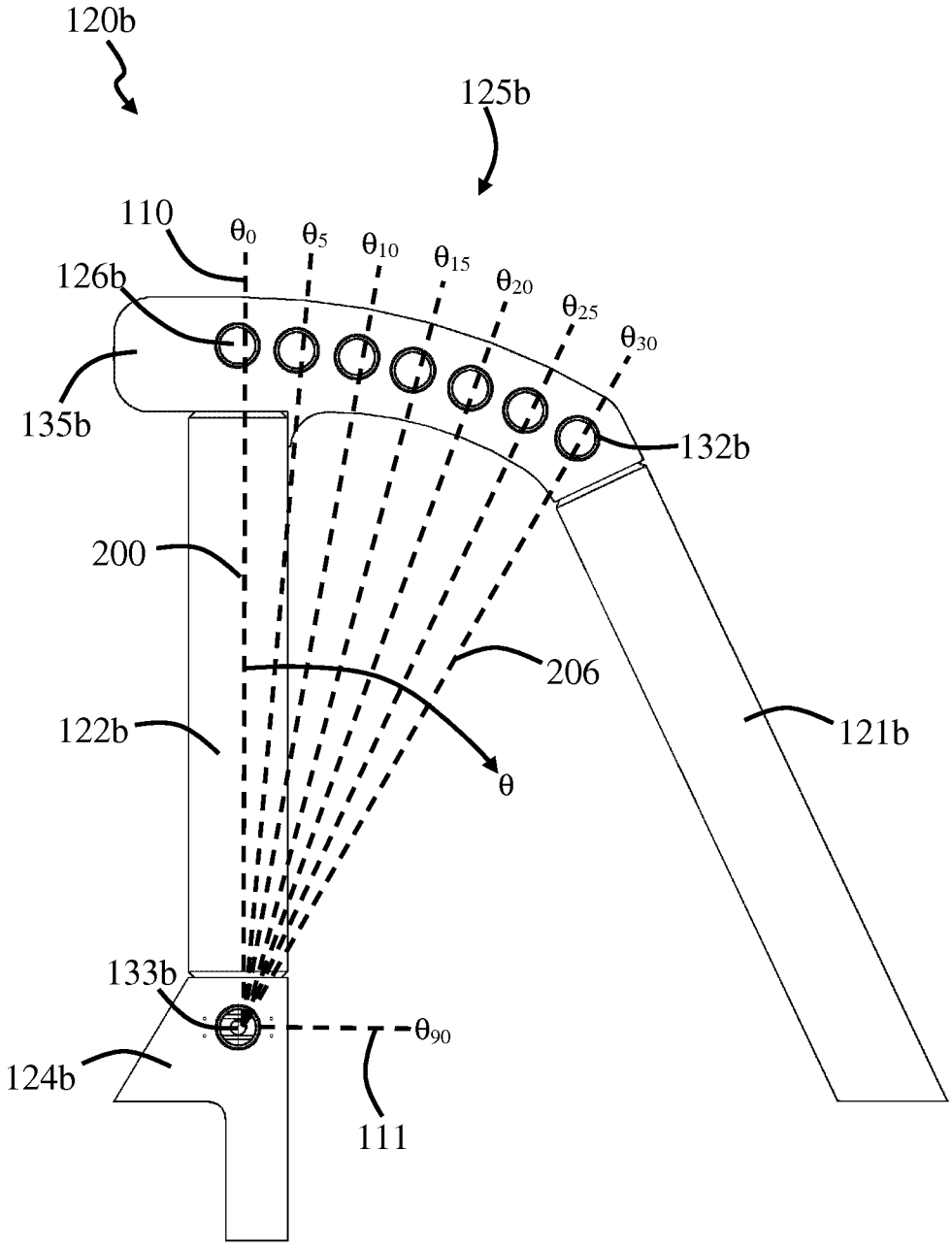

FIGS. 8*a* and 8*b* are side views of angle bracket assembly 120*a*, and FIGS. 8*c* and 8*d* are side views of angle bracket assembly 120*b*. In this embodiment, angle pin sockets 125*a* include seven angle pin sockets, denoted as angle pin sockets 126*a*, 127*a*, 128*a*, 129*a*, 130*a*, 131*a*, and 132*a*. Angle pin sockets 126*a*, 127*a*, 128*a*, 129*a*, 130*a*, 131*a*, and 132*a* extend through angle bracket 121*a* and along the length of angle bracket 121*a* and away from support arm socket 134*a*. Further, angle pin sockets 125*b* include seven angle pin sockets, denoted as angle pin sockets 126*b*, 127*b*, 128*b*, 129*b*, 130*b*, 131*b*, and 132*b*. Angle pin sockets 126*b*, 127*b*, 128*b*, 129*b*, 130*b*, 131*b*, and 132*b* extend through angle bracket 121*b* and along the length of angle bracket 121*b* and away from support arm socket 134*b*. In general, the number of angle pin sockets extending through angle brackets 121*a* and 121*b* is the same.

In this embodiment, angle pin sockets 126*a*, 127*a*, 128*a*, 129*a*, 130*a*, 131*a*, and 132*a* are spaced apart from each other so that they are at predetermined positions along angle bracket arm 135*a*. The predetermined positions of angle pin sockets 126*a*, 127*a*, 128*a*, 129*a*, 130*a*, 131*a*, and 132*a* are chosen so that reference planes extend at predetermined angles through pivot pin socket 133*a* and angle pin sockets 126*a*, 127*a*, 128*a*, 129*a*, 130*a*, 131*a*, and 132*a*, wherein, in this embodiment, the predetermined angle is relative to reference line 110. It should be noted that angle pin sockets 126*a*, 127*a*, 128*a*, 129*a*, 130*a*, 131*a*, and 132*a* are equidistantly spaced apart from each other in this embodiment. However, the spacing between adjacent angle pin sockets 126*a*, 127*a*, 128*a*, 129*a*, 130*a*, 131*a*, and 132*a* can be different, if desired.

In this embodiment, angle pin sockets 126*b*, 127*b*, 128*b*, 129*b*, 130*b*, 131*b*, and 132*b* are spaced apart from each other so that they are at predetermined positions along angle bracket arm 135*b*. The predetermined positions of angle pin sockets 126*b*, 127*b*, 128*b*, 129*b*, 130*b*, 131*b*, and 132*b* are chosen so that reference planes extend at predetermined angles through pivot pin socket 133*b* and angle pin sockets 126*b*, 127*b*, 128*b*, 129*b*, 130*b*, 131*b*, and 132*b*, wherein, in this embodiment, the predetermined angle is relative to reference line 110. It should be noted that angle pin sockets 126*b*, 127*b*, 128*b*, 129*b*, 130*b*, 131*b*, and 132*b* are equidistantly spaced apart from each other in this embodiment. However, the spacing between adjacent angle pin sockets 126*b*, 127*b*, 128*b*, 129*b*, 130*b*, 131*b*, and 132*b* can be different, if desired. Further, it should be noted that angle pin sockets 126*b*, 127*b*, 128*b*, 129*b*, 130*b*, 131*b*, and 132*b* oppose angle pin sockets 126*a*, 127*a*, 128*a*, 129*a*, 130*a*, 131*a*, and 132*a*, respectively.

Figure 8E:
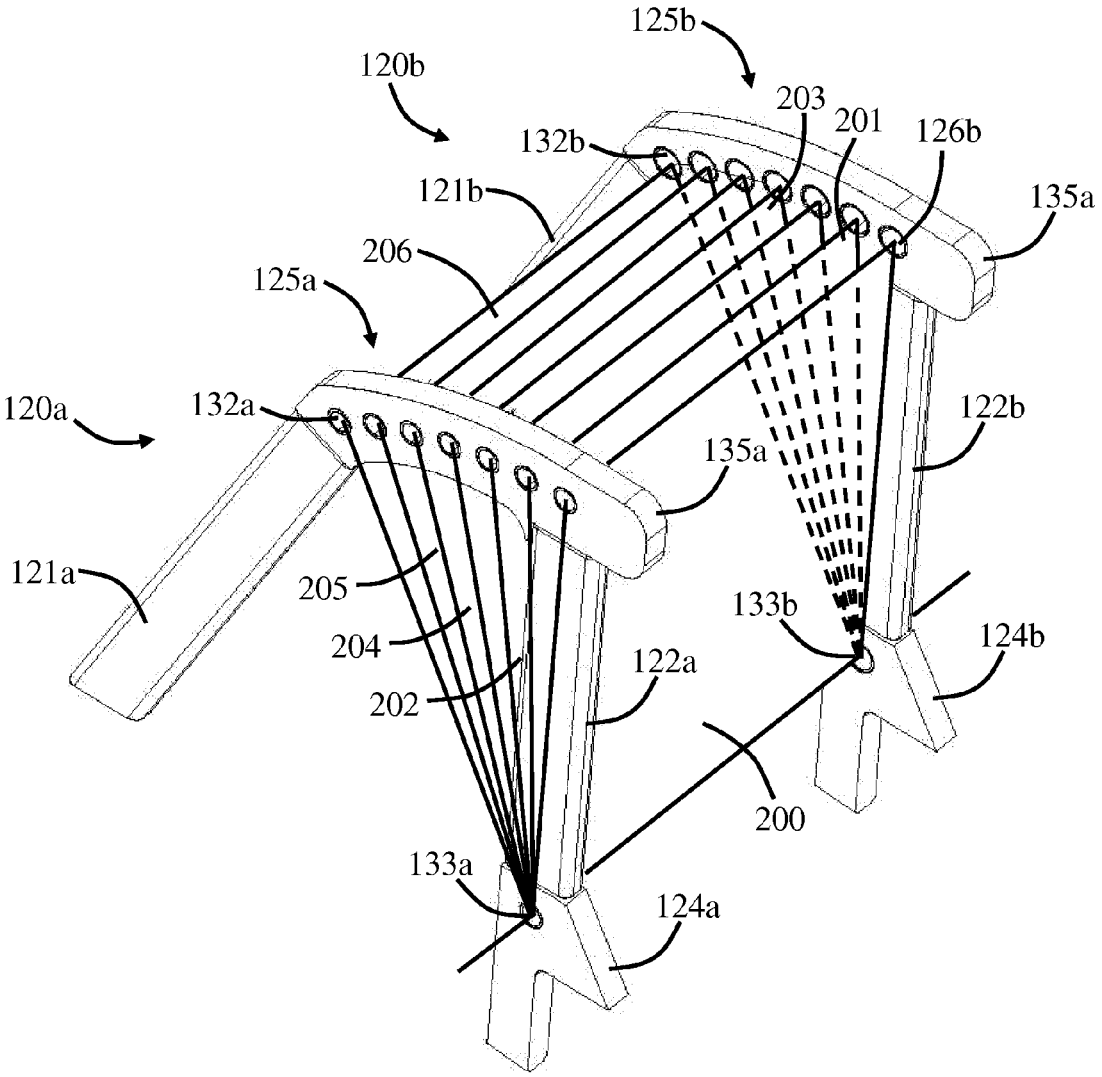
FIG. 8*e* is a perspective view of the tower interface assembly showing planes which extend between opposed angle pin sockets.

FIG. 8*e* is a perspective view of tower interface assembly 118 and the reference planes mentioned above. As shown in FIGS. 1*a*, 1*b* and 1*c*, reference line 110 extends between angle pin socket 126*a* and pivot pin socket 133*a* along the length of angle bracket support leg 122*a*. Further, reference line 110 extends between angle pin socket 126*b* and pivot pin socket 133*b* along the length of angle bracket support leg 122*b*.

Figure 9A:
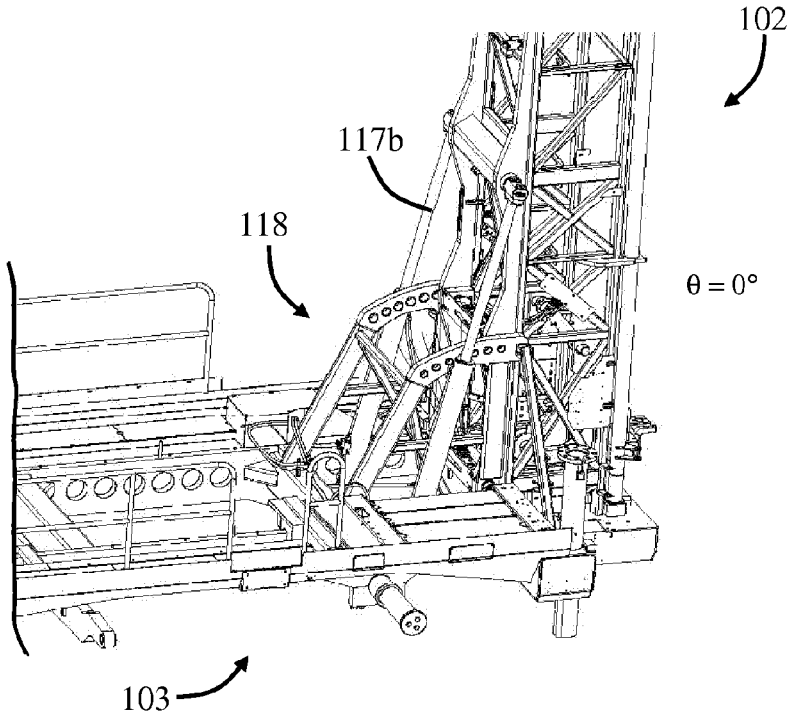
FIGS. 9*a* and 9*b* are perspective views of the tower of FIG. 1*a* held at an angle of 0° by the tower interface assembly.
Figure 9B:
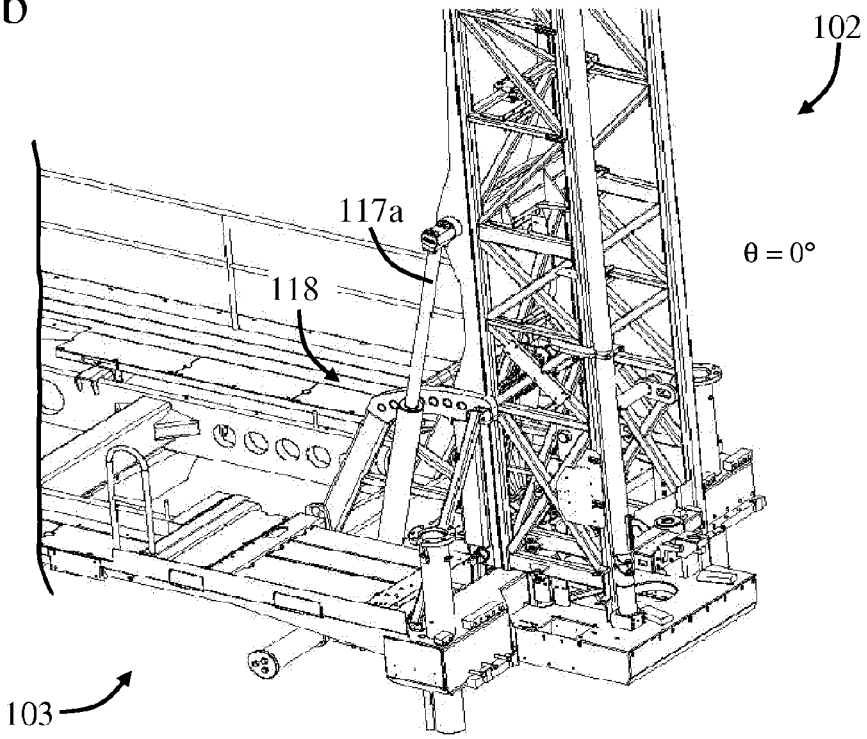

As shown in FIG. 8*e*, a reference plane 200 extends between angle pin sockets 126*a* and 126*b* and pivot pin sockets 133*a* and 133*b* at angle $\theta_0$ relative to reference line 110, wherein angle $\theta_0$ is about 0° in this example. It should be noted that reference plane 200 extends perpendicular to reference line 111 of FIGS. 1*a*, 1*b* and 1*c*. FIGS. 9*a* and 9*b* are perspective views of tower 102 held at an angle of about 0° by tower interface assembly 118. It should be noted that, in FIGS. 9*a* and 9*b*, angle pins 141*a* and 141*b* extend through angle pin sockets 126*a* and 126*b*, respectively.

A reference plane 201 extends between angle pin sockets 127*a* and 127*b* and pivot pin sockets 133*a* and 133*b* at an angle $\theta_5$ relative to reference line 110, wherein angle $\theta_5$ is about 5° in this example. A reference plane 202 extends between angle pin sockets 128*a* and 128*b* and pivot pin sockets 133*a* and 133*b* at an angle $\theta_{10}$ relative to reference line 110, wherein angle $\theta_{10}$ is about 10° in this example.

Figure 9C:
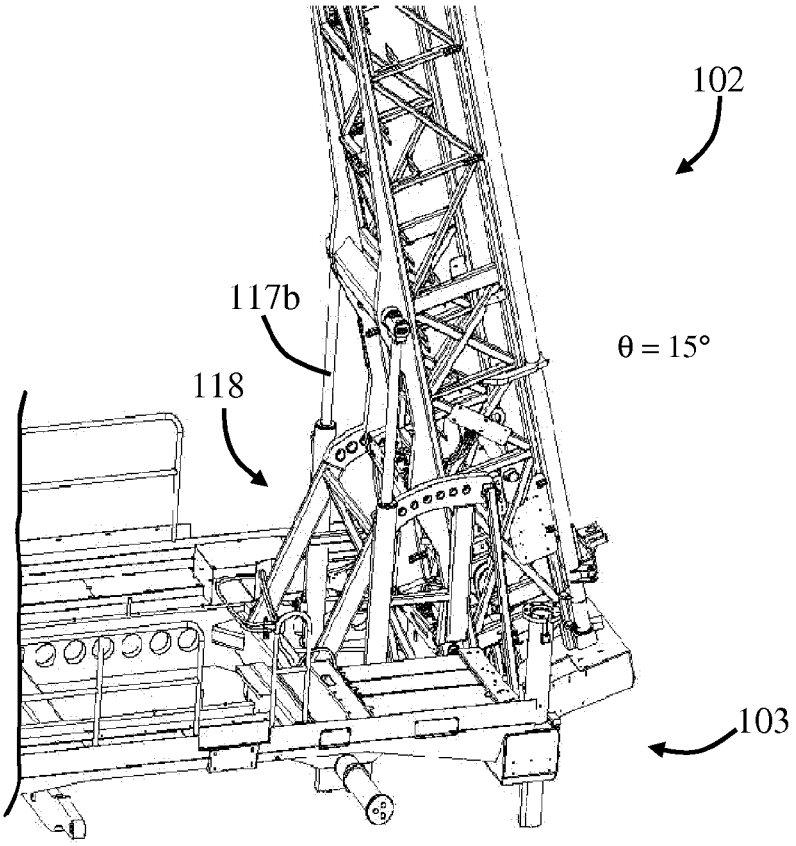
FIGS. 9*c* and 9*d* are perspective views of the tower of FIG. 1*a* held at an angle of 15° by the tower interface assembly.
Figure 9D:
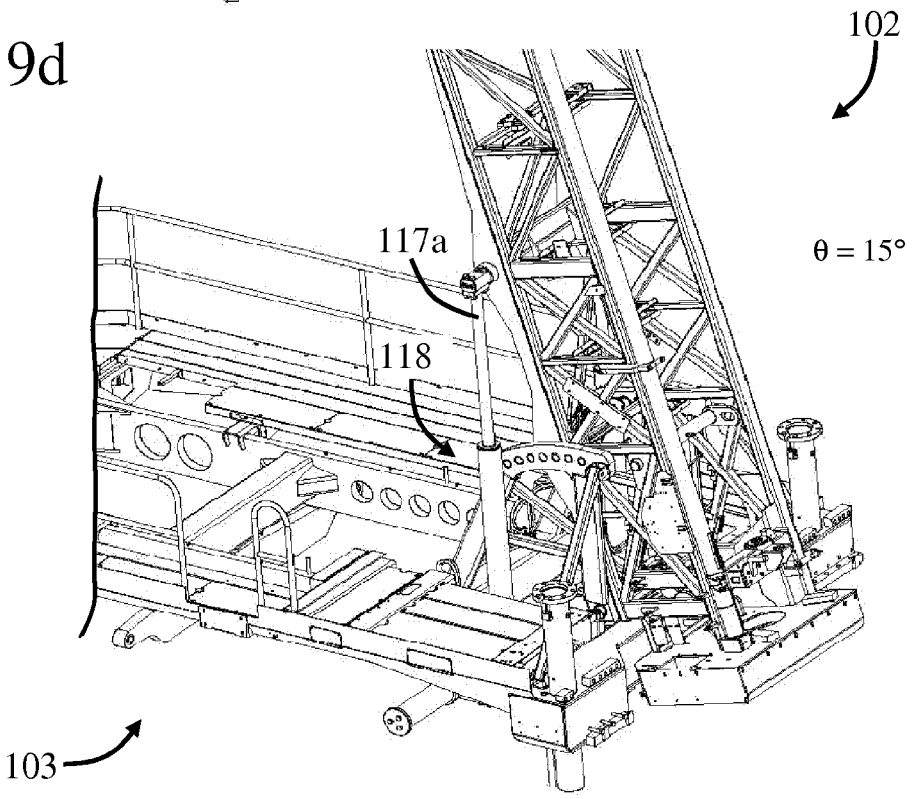

A reference plane 203 extends between angle pin sockets 129*a* and 129*b* and pivot pin sockets 133*a* and 133*b* at an angle $\theta_{15}$ relative to reference line 110, wherein angle $\theta_{15}$ is about 15° in this example. FIGS. 9*c* and 9*d* are perspective views of tower 102 held at an angle of about 15° by tower interface assembly 118. It should be noted that, in FIGS. 9*c* and 9*d*, angle pins 141*a* and 141*b* extend through angle pin sockets 129*a* and 129*b*, respectively.

A reference plane 204 extends between angle pin sockets 130*a* and 130*b* and pivot pin sockets 133*a* and 133*b* at an angle $\theta_{20}$ relative to reference line 110, wherein angle $\theta_{20}$ is about 20° in this example. A reference plane 205 extends between angle pin sockets 131*a* and 131*b* and pivot pin sockets 133*a* and 133*b* at an angle $\theta_{25}$ relative to reference line 110, wherein angle $\theta_{25}$ is about 25° in this example.

Figure 9E:
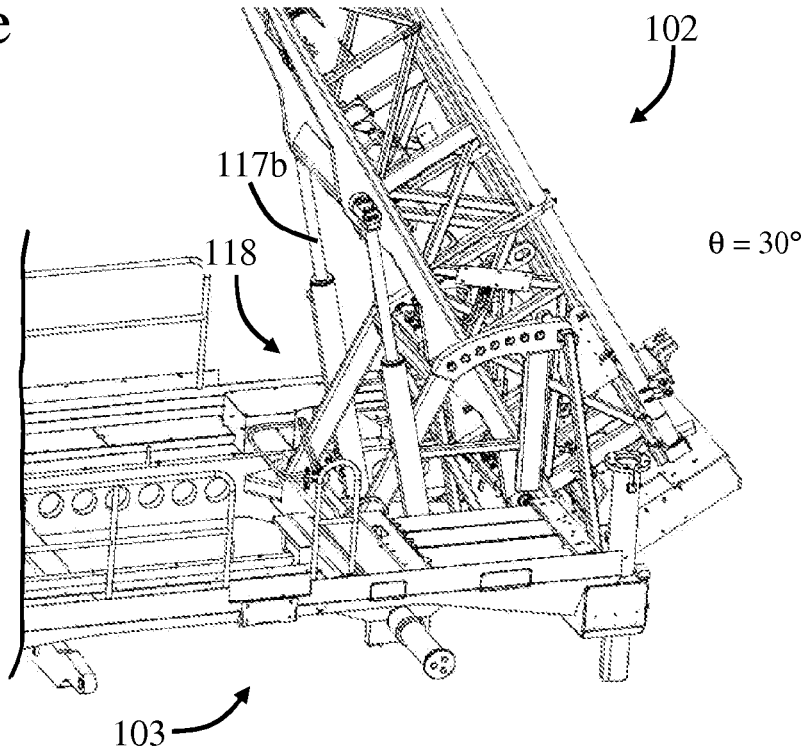
FIGS. 9*e*, 9*f* and 9*g* are perspective views of the tower of FIG. 1*a* held at an angle of 30° by the tower interface assembly.
Figure 9F:
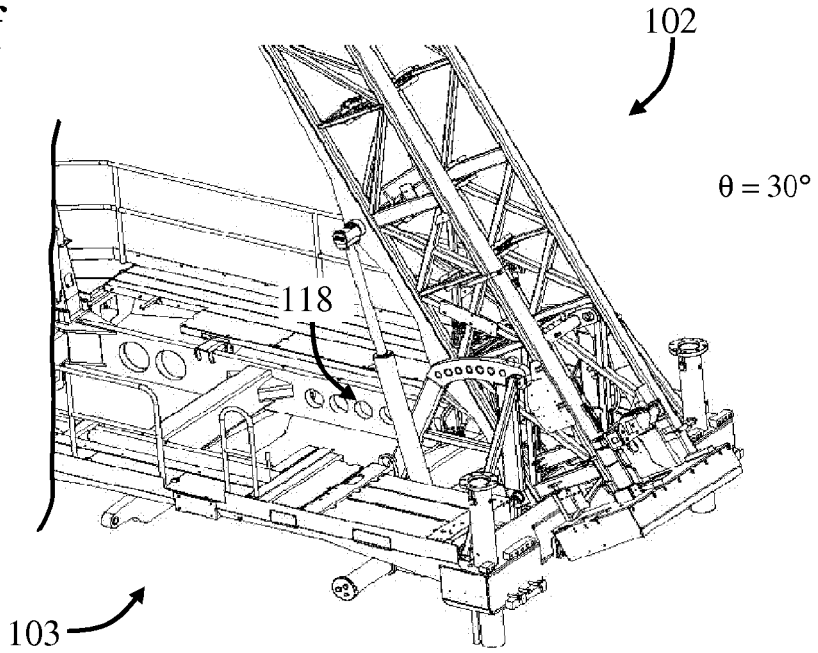
Figure 9G:
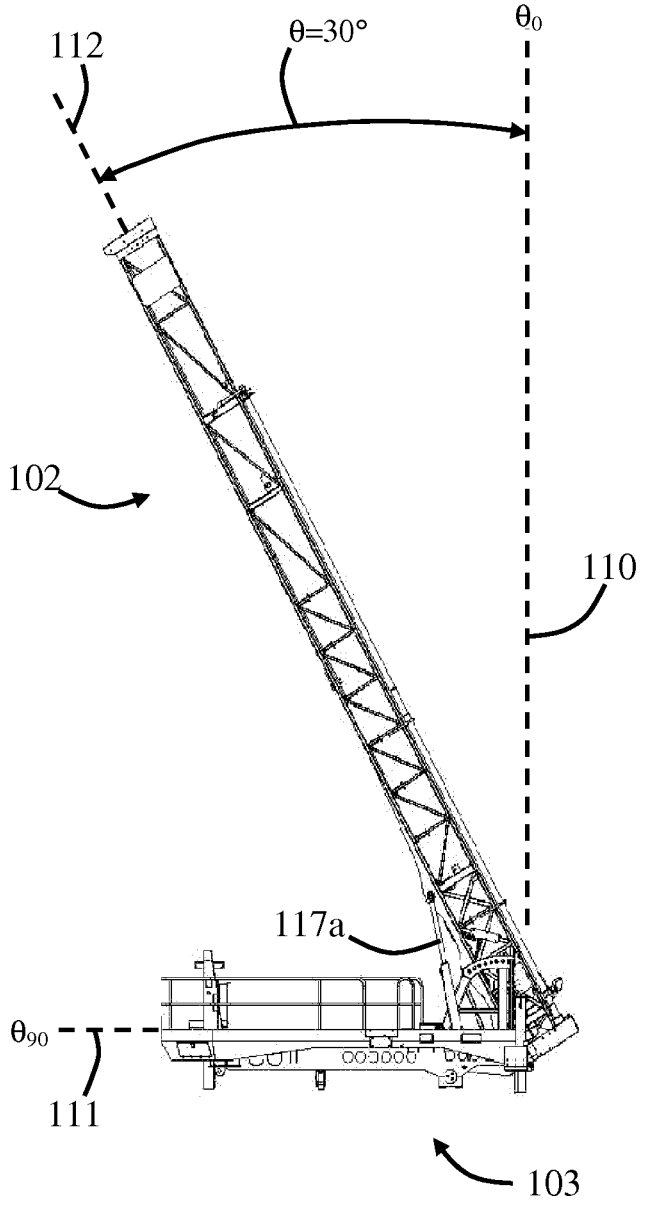

A reference plane 206 extends between angle pin sockets 132*a* and 132*b* and pivot pin sockets 133*a* and 133*b* at an angle $\theta_{30}$ relative to reference line 110, wherein angle $\theta_{30}$ is about 30° in this example. FIGS. 9*e*, 9*f* and 9*g* are perspective views of tower 102 held at an angle of about 30° by tower interface assembly 118. It should be noted that, in FIGS. 9*e*, 9*f* and 9*g*, angle pins 141*a* and 141*b* extend through angle pin sockets 132*a* and 132*b*, respectively. In this way, the angle pin sockets that extend through angle bracket arms 135*a* and 135*b* are spaced apart from each other at positions which correspond to predetermined angles relative to reference line 110.

It should be noted that angle pin socket 132*a* is rearward of angle pin sockets 126*a*, 127*a*, 128*a*, 129*a*, 130*a* and 131*a* because angle $\theta_{30}$ is greater than angles $\theta_0$, $\theta_5$, $\theta_{10}$, $\theta_{15}$, $\theta_{20}$, and $\theta_{25}$. Further, angle pin socket 131*a* is rearward of angle pin sockets 126*a*, 127*a*, 128*a*, 129*a* and 130*a* because angle $\theta_{25}$ is greater than angles $\theta_0$, $\theta_5$, $\theta_{10}$, $\theta_{15}$ and $\theta_{20}$. Angle pin socket 130*a* is rearward of angle pin sockets 126*a*, 127*a*, 128*a* and 129*ab* because angle $\theta_{20}$ is greater than angles $\theta_0$, $\theta_5$, $\theta_{10}$ and $\theta_{15}$. Angle pin socket 129*a* is rearward of angle pin sockets 126*a*, 127*a* and 128*a* because angle $\theta_{15}$ is greater than angles $\theta_0$, $\theta_5$ and $\theta_{10}$. Angle pin socket 128*a* is rearward of angle pin sockets 126*a* and 127*a* because angle $\theta_{10}$ is greater than angles $\theta_0$ and $\theta_5$. Angle pin socket 127*a* is rearward of angle pin socket 126*a* because angle $\theta_5$ is greater than angles $\theta_0$.

It should be noted that angle pin socket 132*b* is rearward of angle pin sockets 126*b*, 127*b*, 128*b*, 129*b*, 130*b* and 131*b* because angle $\theta_{30}$ is greater than angles $\theta_0$, $\theta_5$, $\theta_{10}$, $\theta_{15}$, $\theta_{20}$, and $\theta_{25}$. Further, angle pin socket 131*b* is rearward of angle pin sockets 126*b*, 127*b*, 128*b*, 129*b* and 130*b* because angle $\theta_{25}$ is greater than angles $\theta_0$, $\theta_5$, $\theta_{10}$, $\theta_{15}$ and $\theta_{20}$. Angle pin socket 130*b* is rearward of angle pin sockets 126*b*, 127*b*, 128*b* and 129*b* because angle $\theta_{20}$ is greater than angles $\theta_0$, $\theta_5$, $\theta_{10}$ and $\theta_{15}$. Angle pin socket 129*b* is rearward of angle pin sockets 126*b*, 127*b* and 128*b* because angle $\theta_{15}$ is greater than angles $\theta_0$, $\theta_5$ and $\theta_{10}$. Angle pin socket 128*b* is rearward of angle pin sockets 126*b* and 127*b* because angle $\theta_{10}$ is greater than angles $\theta_0$ and $\theta_5$. Angle pin socket 127*b* is rearward of angle pin socket 126*b* because angle $\theta_5$ is greater than angles $\theta_0$.

As mentioned above, reference line 112 (FIGS. 1*a*, 1*b* and 1*c* and FIGS. 9*c* and 9*d*) extends parallel to tower 102. Hence, tower 102 extends angle $\theta_0$ relative to reference line 110 and reference line 112 extends through reference plane 200 when tower 102 is in the raised position and angle pin actuator 140 extends through angle pin sockets 126*a* and 126*b*. In particular, tower 102 extends at angle $\theta_0$ relative to reference line 110 and reference line 112 extends through reference plane 200 when tower 102 is in the raised position and angle pins 141*a* and 141*b* extend through angle pin sockets 126*a* and 126*b*, respectively.

Tower 102 extends at angle $\theta_5$ relative to reference line 110 and reference line 112 extends through reference plane 201 when tower 102 is in the tilted position and angle pin actuator 140 extends through angle pin sockets 127*a* and 127*b*. In particular, tower 102 extends at angle $\theta_5$ relative to reference line 110 and reference line 112 extends through reference plane 201 when tower 102 is in the tilted position and angle pins 141*a* and 141*b* extend through angle pin sockets 127*a* and 127*b*, respectively.

Tower 102 extends at angle $\theta_{10}$ relative to reference line 110 and reference line 112 extends through reference plane 202 when tower 102 is in the tilted position and angle pin actuator 140 extends through angle pin sockets 128*a* and 128*b*. In particular, tower 102 extends at angle $\theta_{10}$ relative to reference line 110 and reference line 112 extends through reference plane 202 when tower 102 is in the tilted position and angle pins 141*a* and 141*b* extend through angle pin sockets 128*a* and 128*b*, respectively.

Tower 102 extends at angle $\theta_{15}$ (FIGS. 9*c* and 9*d*) relative to reference line 110 and reference line 112 extends through reference plane 203 when tower 102 is in the tilted position and angle pin actuator 140 extends through angle pin sockets 129*a* and 129*b*. In particular, tower 102 extends at angle $\theta_{15}$ relative to reference line 110 and reference line 112 extends through reference plane 203 when tower 102 is in the tilted position and angle pins 141*a* and 141*b* extend through angle pin sockets 129*a* and 129*b*, respectively.

Tower 102 extends at angle $\theta_{20}$ relative to reference line 110 and reference line 112 extends through reference plane 204 when tower 102 is in the tilted position and angle pin actuator 140 extends through angle pin sockets 130*a* and 130*b*. In particular, tower 102 extends at angle $\theta_{20}$ relative to reference line 110 and reference line 112 extends through reference plane 204 when tower 102 is in the tilted position and angle pins 141*a* and 141*b* extend through angle pin sockets 130*a* and 130*b*, respectively.

Tower 102 extends at angle $\theta_{25}$ relative to reference line 110 and reference line 112 extends through reference plane 205 when tower 102 is in the tilted position and angle pin actuator 140 extends through angle pin sockets 131*a* and 131*b*. In particular, tower 102 extends at angle $\theta_{25}$ relative to reference line 110 and reference line 112 extends through reference plane 205 when tower 102 is in the tilted position and angle pins 141*a* and 141*b* extend through angle pin sockets 131*a* and 131*b*, respectively.

Tower 102 extends at angle $\theta_{30}$ (FIGS. 9*e*, 9*f* and 9*g*) relative to reference line 110 and reference line 112 extends through reference plane 206 when tower 102 is in the tilted position and angle pin actuator 140 extends through angle pin sockets 132*a* and 132*b*. In particular, tower 102 extends at angle $\theta_{30}$ relative to reference line 110 and reference line 112 extends through reference plane 206 when tower 102 is in the tilted position and angle pins 141*a* and 141*b* extend through angle pin sockets 132*a* and 132*b*, respectively.

Reference line 112 extends at angle $\theta_{90}$ relative to reference line 110 and reference line 112 extends parallel to reference line 111 (FIGS. 1*a*, 1*b* and 1*c*) when tower 102 is in the lowered position. As mentioned above, when tower 102 is in the lowered position, pivot pin actuator 150 is in the retracted condition and does not extend through pivot pin sockets 133*a* and 133*b*. In particular, when tower 102 is in the lowered position, pivot pin actuator 150 is in the retracted condition and pivot pins 151*a* and 151*b* do not extend through pivot pin sockets 133*a* and 133*b*, respectively. However, angle pin actuator 140 does extend through angle pin sockets 126*a* and 126*b* so that tower 102 can be moved between the raised and lowered positions. Hence, tower 102 is rotatably mounted to tower interface assembly 118 through angle pin actuator 140 when tower 102 is moved to and from the stowed condition. In particular, tower 102 is rotatably mounted to tower interface assembly 118 through angle pins 141*a* and 141*b* when tower 102 is moved to and from the stowed condition (FIG. 1*a*). In this embodiment, angle pins 141*a* and 141*b* extend through angle pin sockets 126*a* and 126*b*, respectively, when tower 102 is moved to and from the stowed condition.

Figure 10A:
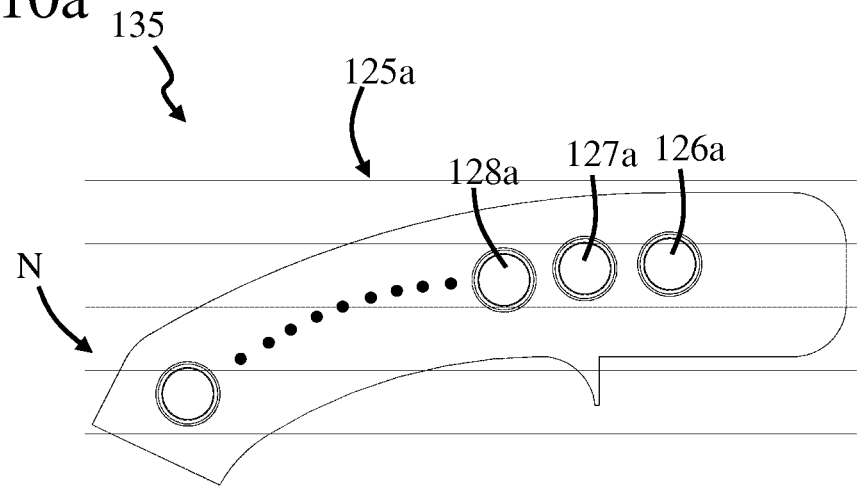
FIGS. 10*a*, 10*b* and 10*c* are side views of different embodiments of angle bracket arms, which can be included with the tower interface assembly.
Figure 10B:
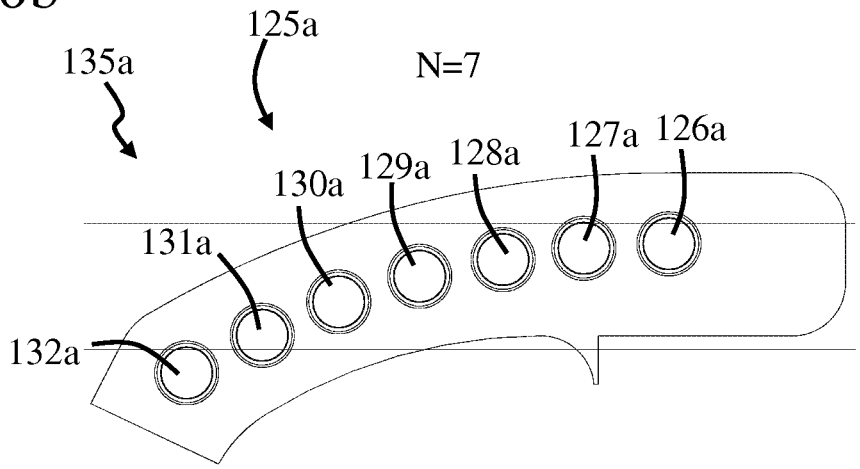
Figure 10C:
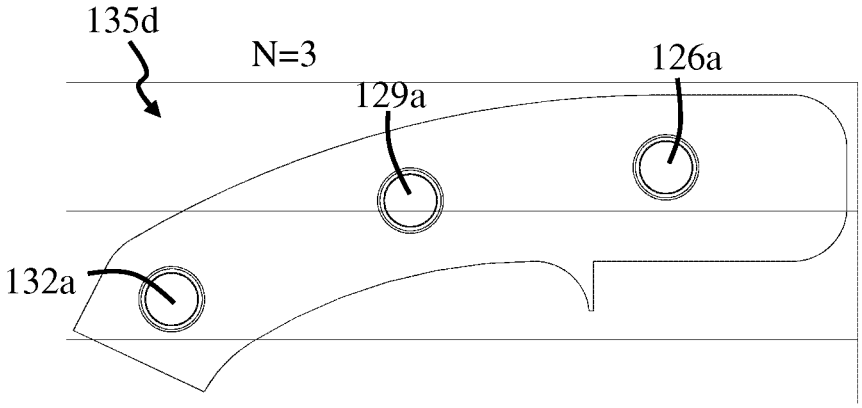

FIGS. 10*a*, 10*b* and 10*c* are side views of other embodiments of angle bracket arms which can be included with drilling machine 100. In FIG. 10*a*, an angle bracket arm 135 includes a number N of angle bracket sockets so that a corresponding number of discrete angles are available. As number N increases, the number of discrete angles available increases and, as number N decreases, the number of discrete angles available decreases. In general, the number of discrete angles available range from 0° to 90°. In this way, the angles available for tower 102 to be tilted correspond to N discrete angular values. It should be noted, however, that the angles can be negative angles wherein tower 102 tilts towards cab 105 and vehicle front 101*a*.

The number N can have many different values. In one embodiment, the number N has values in a range from two to about ten. In another embodiment, the number N has values in a range from two to about fifteen. In one particular example, N is equal to two. It should be noted, however, that the number N can have values outside of these ranges in other embodiments.

In FIG. 10*b*, angle bracket arm 135*a* includes a number of angle bracket sockets which corresponds to seven. More information regarding angle bracket arm 135*a* is provided above with the discussion of tower interface assembly 118. In the embodiment of FIG. 10*b*, the available angles that tower 102 can be tilted correspond to angle values equal to 0° and 30°, as well as values therebetween that are at 5° increments (i.e. 5°, 10°, 15°, 20°, 25°). In this way, the angles available for tower 102 to be positioned correspond to seven discrete angular values. It should be noted, however, that the angles can have other discrete angular values, and these discrete values can be greater than 30°.

In FIG. 10*c*, an angle bracket arm 135*d* includes a number of angle bracket sockets which corresponds to three. In the embodiment of FIG. 10*c*, the available angles that tower 102 can be tilted correspond to angle values equal to 0° and 30°, as well as values therebetween that are at 15° increments. In this way, the angles available for tower 102 to be positioned correspond to three discrete angular values, as will be discussed in more detail presently.

Figure 11A:
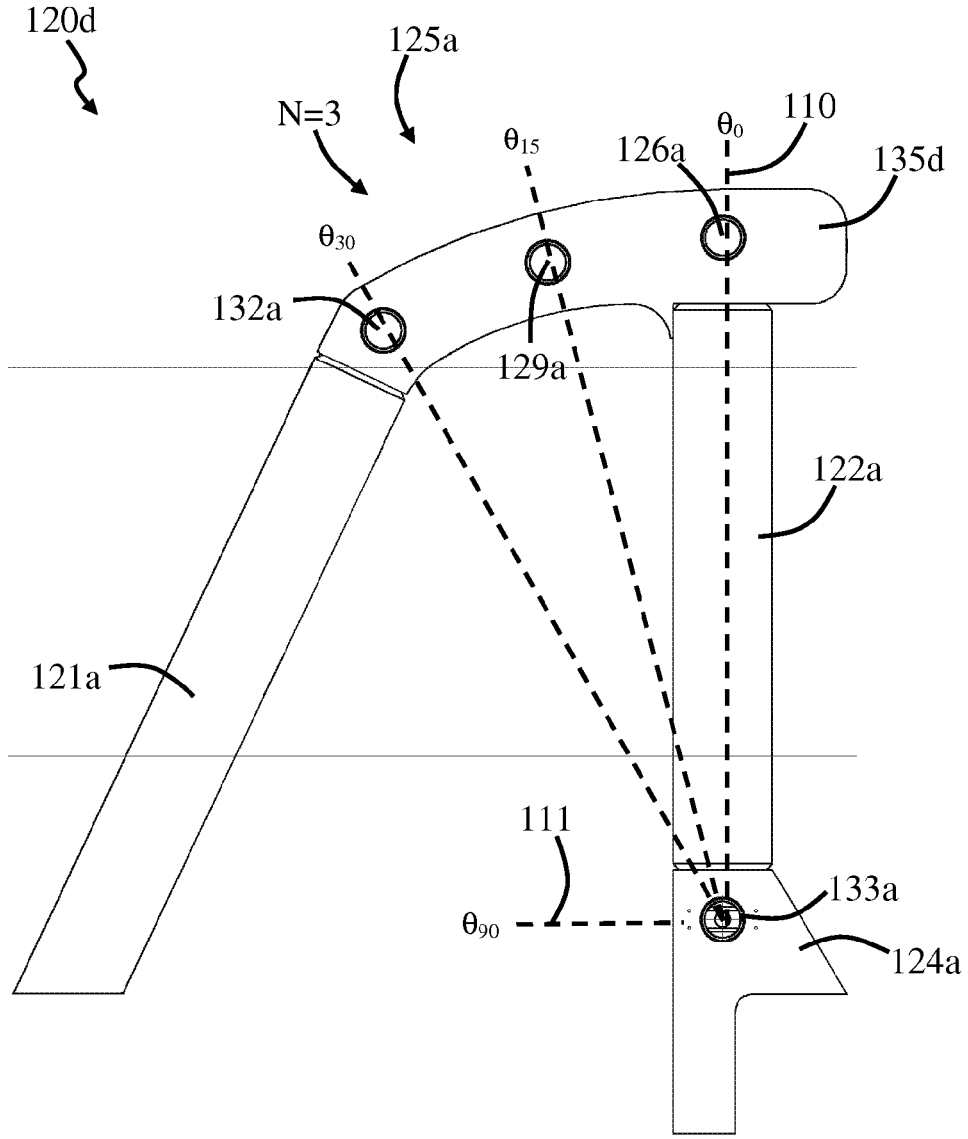
FIGS. 11*a*, 11*b* and 11*c* are side, side and perspective views of another embodiment of opposed angle bracket assemblies, which each include the angle bracket arm of FIG. 10*c*.
Figure 11B:
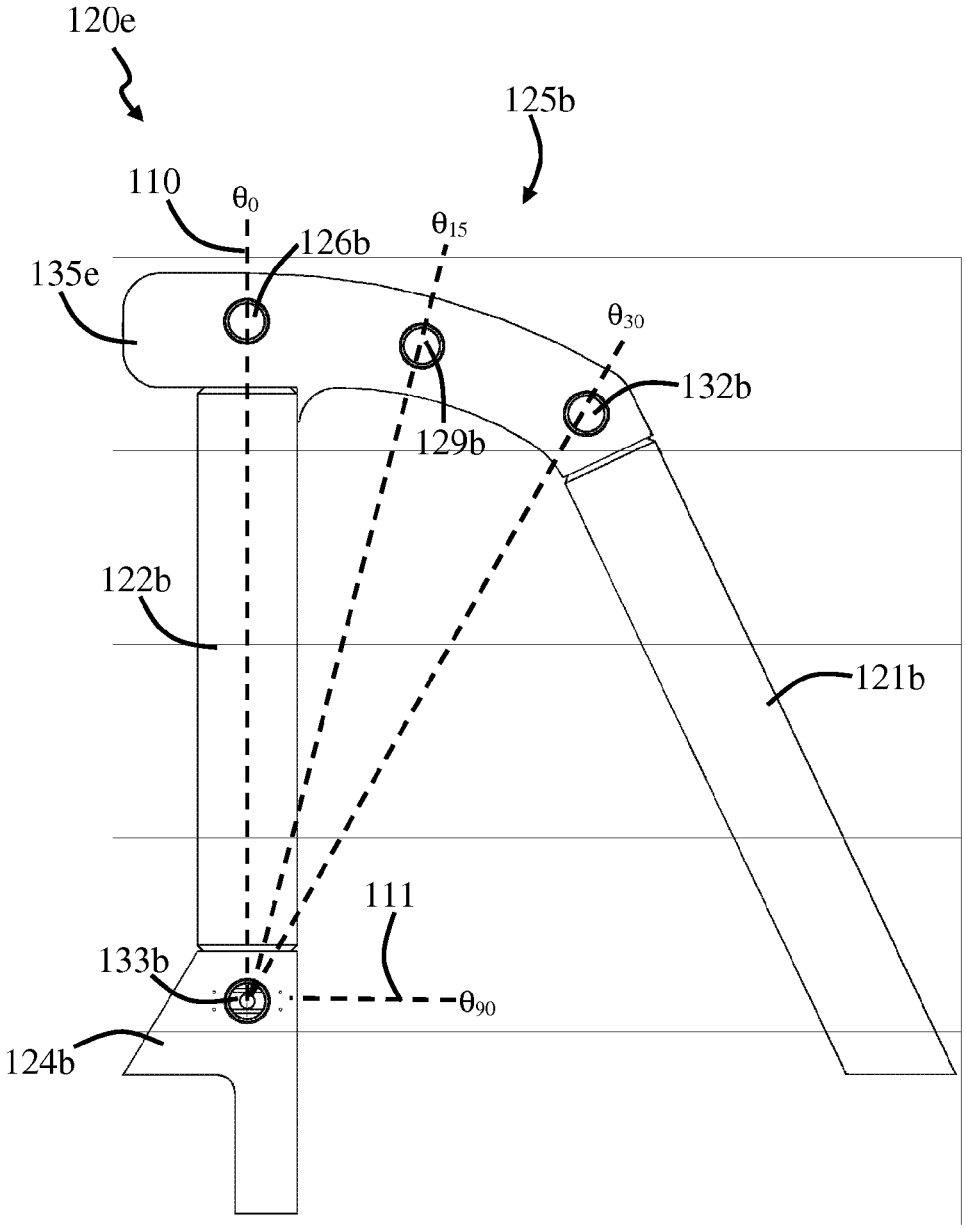

FIGS. 11*a* and 11*b* are side views of angle bracket assemblies 120*d* and 120*e*, respectively, which include angle bracket arms 135*d* and 135*e*, respectively. More information regarding angle bracket arm 125*d* is provided with FIG. 10*c* above. It should be noted that, in this embodiment, angle bracket arm 135*e* is the same as angle bracket arm 135*d*. Hence, for angle brackets 135*d* and 135*e*, N is equal to three so that angle bracket arms 135*d* and 135*e* each include three angle pin sockets. The angle pin sockets of angle bracket arms 135*d* and 135*e* are positioned so they oppose each other.

In this embodiment, the angle pin sockets of angle bracket arm 135*d* are denoted as angle pin sockets 126*a*, 129*a*, and 132*a*. Further, the angle pin sockets of angle bracket arm 135*e* are denoted as angle pin sockets 126*b*, 129*b*, and 132*b*.

In this embodiment, angle pin sockets 126*a*, 129*a*, and 132*a* are spaced apart from each other so that they are at predetermined positions along angle bracket arm 135*d*. The predetermined positions of angle pin sockets 126*a*, 129*a*, and 132*a* are chosen so that reference planes extend at predetermined angles through pivot pin socket 133*a* and angle pin sockets 126*a*, 129*a*, and 132*a*, wherein, in this embodiment, the predetermined angle is relative to reference line 110. It should be noted that angle pin sockets 126*a*, 129*a*, and 132*a* are equidistantly spaced apart from each other in this embodiment. However, the spacing between adjacent angle pin sockets 126*a*, 129*a*, and 132*a* can be different, if desired.

In this embodiment, angle pin sockets 126*b*, 129*b*, and 132*b* are spaced apart from each other so that they are at predetermined positions along angle bracket arm 135*b*. The predetermined positions of angle pin sockets 126*b*, 129*b*, and 132*b* are chosen so that reference planes extend at predetermined angles through pivot pin socket 133*b* and angle pin sockets 126*b*, 129*b*, and 132*b*, wherein, in this embodiment, the predetermined angle is relative to reference line 110. It should be noted that angle pin sockets 126*b*, 129*b*, and 132*b* are equidistantly spaced apart from each other in this embodiment. However, the spacing between adjacent angle pin sockets 126*b*, 129*b*, and 132*b* can be different, if desired. Further, it should be noted that angle pin sockets angle pin sockets 126*b*, 129*b*, and 132*b* oppose angle pin sockets angle pin sockets 126*a*, 129*a*, and 132*a*, respectively.

Figure 11C:
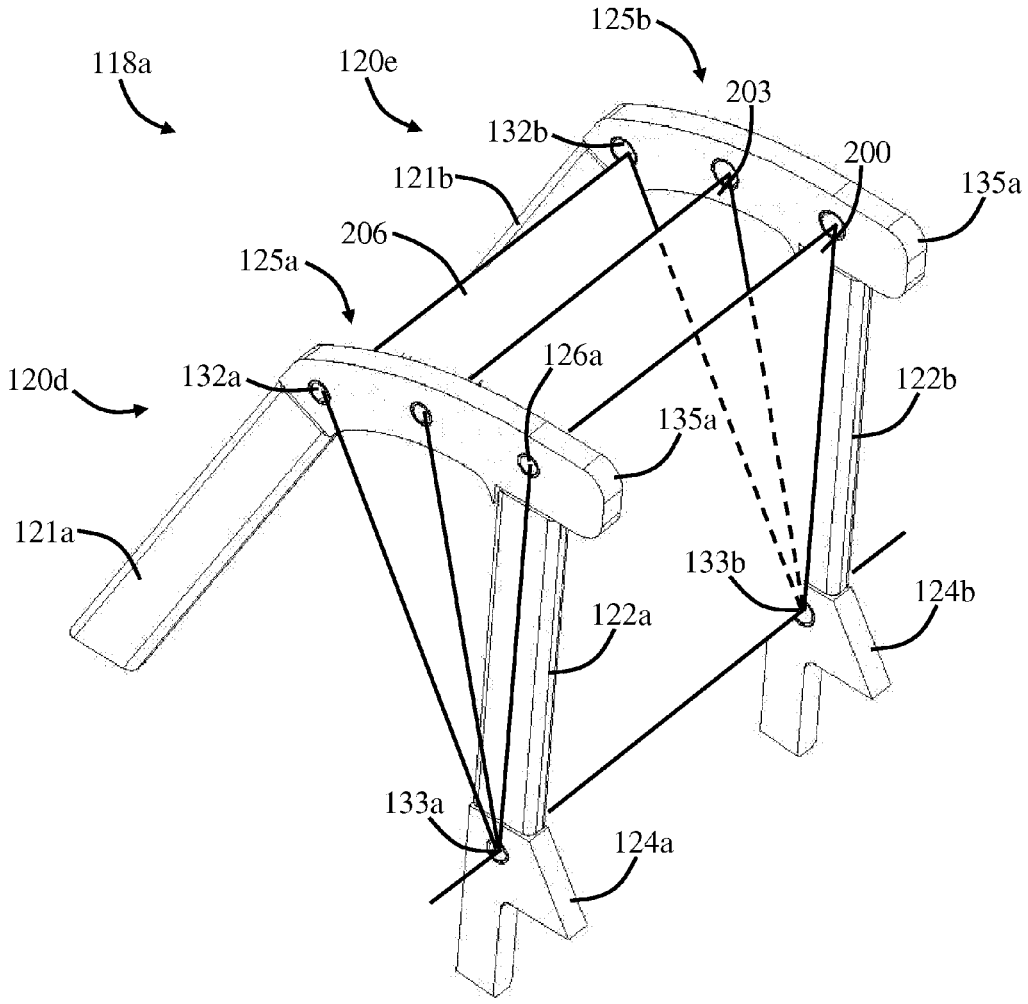

FIG. 11*c* is a perspective view of tower interface assembly 118*a*, which includes angle bracket assemblies 120*d* and 120*e* and the reference planes mentioned above with the discussion of FIGS. 11*a* and 11*b*. As shown in FIG. 11*c*, reference plane 200 extends between angle pin sockets 126*a* and 126*b* and pivot pin sockets 133*a* and 133*b* at angle $\theta_0$ relative to reference line 110, wherein angle $\theta_0$ is about 0° in this example.

Reference plane 203 extends between angle pin sockets 129*a* and 129*b* and pivot pin sockets 133*a* and 133*b* at an angle $\theta_{15}$ relative to reference line 110, wherein angle $\theta_{15}$ is about 15° in this example. Further, reference plane 206 extends between angle pin sockets 132*a* and 132*b* and pivot pin sockets 133*a* and 133*b* at an angle $\theta_{30}$ relative to reference line 110, wherein angle $\theta_{30}$ is about 30° in this example. In this way, the angle pin sockets that extend through angle bracket arms 135*d* and 135*e* are spaced apart from each other at positions which correspond to predetermined angles relative to reference line 110.

As mentioned above, reference line 112 (FIGS. 1*a*, 1*b* and 1*c*) extends parallel to tower 102. Hence, tower 102 extends angle $\theta_0$ relative to reference line 110 and reference line 112 extends through reference plane 200 when tower 102 is in the raised position and angle pin actuator 140 extends through angle pin sockets 126*a* and 126*b*. In particular, tower 102 extends at angle $\theta_0$ relative to reference line 110 and reference line 112 extends through reference plane 200 when tower 102 is in the raised position and angle pins 141*a* and 141*b* extend through angle pin sockets 126*a* and 126*b*, respectively.

Tower 102 extends at angle $\theta_{15}$ relative to reference line 110 and reference line 112 extends through reference plane 203 when tower 102 is in the tilted position and angle pin actuator 140 extends through angle pin sockets 129*a* and 129*b*. In particular, tower 102 extends at angle $\theta_{15}$ relative to reference line 110 and reference line 112 extends through reference plane 203 when tower 102 is in the tilted position and angle pins 141*a* and 141*b* extend through angle pin sockets 129*a* and 129*b*, respectively.

Tower 102 extends at angle $\theta_{30}$ relative to reference line 110 and reference line 112 extends through reference plane 206 when tower 102 is in the tilted position and angle pin actuator 140 extends through angle pin sockets 132*a* and 132*b*. In particular, tower 102 extends at angle $\theta_{30}$ relative to reference line 110 and reference line 112 extends through reference plane 206 when tower 102 is in the tilted position and angle pins 141*a* and 141*b* extend through angle pin sockets 132*a* and 132*b*, respectively.

The embodiments of the invention described herein are exemplary and numerous modifications, variations and rearrangements can be readily envisioned to achieve substantially equivalent results, all of which are intended to be embraced within the spirit and scope of the invention.

The invention claimed is:

1. A drilling machine, comprising:
a tower; and
a tower interface assembly, which carries the tower, wherein the tower interface assembly includes
first and second angle bracket arms having a plurality of opposed angle pin sockets; and
first and second angle bracket support leg bases which support the first and second angle bracket arms, respectively, wherein:
the first and second angle bracket support leg bases include opposed pivot pin sockets;
the tower includes a pivot pin actuator which is repeatably moveable between engaged and disengaged positions with the pivot pin sockets; and
the pivot pin actuator includes a tapered pivot pin.

2. The machine of claim 1, wherein the tower includes an angle pin actuator which is repeatably between engaged and disengaged positions with corresponding opposed angle pin sockets.

3. The machine of claim 2, wherein the tilt of the tower is adjustable in response to adjusting the corresponding opposed angle pin sockets which are engaged by the angle pin actuator.

4. The machine of claim 2, wherein the angle pin actuator includes a tapered angle pin.

5. The machine of claim 2, wherein the tower is repeatably moveable between stowed and deployed positions in response to moving the pivot pin actuator to the disengaged position with the pivot pin sockets.

6. The machine of claim 5, wherein the tower is repeatably moveable between stowed and deployed positions in response to moving the angle pin actuator to the engaged position with opposed angle pin sockets.

7. A drilling machine, comprising:
a tower; and
a tower interface assembly, which includes
an angle pin actuator having an angle pin cylinder and opposed angle pins; and
first and second sets of opposed angle pin sockets, wherein a tilt angle of the tower is adjustable in response to disengaging and engaging the first and second sets of opposed angle pin sockets, respectively, with the angle pins, wherein the tower interface assembly includes opposed pivot pin sockets and a pivot pin actuator which is repeatably moveable between engaged and disengaged positions with the opposed pivot pin sockets.

8. The machine of claim 7, wherein the second set of opposed angle pin sockets is positioned rearward of the first set of opposed angle pin sockets.

9. The machine claim 7, wherein the tower is in an upright position in response to the pivot pin actuator engaging the opposed pivot pin sockets and the angle pin actuator engaging the first set of opposed angle pin sockets.

10. The machine of claim 7, wherein the tower is in a first tilted position in response to the pivot pin actuator engaging the opposed pivot pin sockets and the angle pin actuator engaging the second set of opposed angle pin sockets.

11. A drilling machine, comprising:

a tower; and a tower interface assembly, which includes an angle pin actuator having a cylinder and opposed angle pins;

opposed angle bracket arms, wherein a tilt angle of the tower is adjustable in response to disengaging and engaging the opposed angle bracket arms, respectively, at opposed predetermined positions with the angle pins;

opposed pivot pin sockets, wherein the tower interface assembly includes a pivot pin actuator which is repeatably moveable between engaged and disengaged positions with the opposed pivot pin sockets, and opposed tower brackets through which the angle pin actuator and pivot pin actuator extend.

12. The machine of claim 11, further including an angle pin socket positioned at each predetermined position.

13. The machine of claim 12, wherein the angle pin actuator moves along the opposed predetermined positions in response to the tower being tilted.

14. The machine of claim 11, wherein the tower interface assembly includes opposed tower brackets through which the angle pin actuator and pivot pin actuator extend.

15. The machine of claim 11, further including an operator's cab with a control system, wherein the control system controls the operation of the angle pin actuator and pivot pin actuator.

16. The machine of claim 11, wherein a second set of opposed angle pin sockets is positioned further from a vehicle than a first set of opposed angle pin sockets.

17. A machine, comprising:

a tower; and a tower interface assembly, which carries the tower, wherein the tower interface assembly includes a pivot pin actuator; and opposed pivot pin sockets, wherein the pivot pin actuator is repeatedly moveable between engaged and disengaged positions with the pivot pin sockets, wherein the pivot pin actuator includes a pivot pin cylinder and opposed pivot pins, and the pivot pins are repeatably moveable between engaged and disengaged positions with the pivot pin sockets in response to actuating the pivot pin cylinder.

18. The machine of claim 17, wherein the pivot pins are repeatably moveable between engaged and disengaged positions with the pivot pin sockets.

19. The machine of claim 17, wherein the tower interface assembly includes first and second angle bracket support leg bases through which the pivot pin sockets extend.

20. The machine of claim 19, wherein the tower interface assembly includes first and second angle bracket arms having a plurality of opposed angle pin sockets.

21. The machine of claim 20, wherein the first and second angle bracket arms are supported by the first and second angle bracket support leg bases.

* * * * *

UNITED STATES PATENT AND TRADEMARK OFFICE

CERTIFICATE OF CORRECTION

PATENT NO. : 8,782,968 B2
APPLICATION NO. : 13/063413
DATED : July 22, 2014
INVENTOR(S) : James M. Benson It is certified that error appears in the above-identified patent and that said Letters Patent is hereby corrected as shown below:

In the Claims:

Col. 20, in claim 2, line 41, add the word "moveable" after the word "repeatably."

Signed and Sealed this
Fourteenth Day of October, 2014

Michelle K. Lee

Michelle K. Lee
*Deputy Director of the United States Patent and Trademark Office*